US009956793B2

(12) United States Patent
Yatsunami et al.

(10) Patent No.: US 9,956,793 B2
(45) Date of Patent: May 1, 2018

(54) PRINTING DEVICE

(71) Applicant: SEIKO EPSON CORPORATION, Tokyo (JP)

(72) Inventors: Tetsuji Yatsunami, Okaya (JP); Takashi Matsuki, Matsumoto (JP); Kazuhiro Nishiyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/453,284

(22) Filed: Mar. 8, 2017

(65) Prior Publication Data

US 2017/0274677 A1 Sep. 28, 2017

(30) Foreign Application Priority Data

Mar. 28, 2016 (JP) ..... 2016-063958

(51) Int. Cl.

| | |
|---|---|
| ***B41J 11/04*** | (2006.01) |
| ***B41J 13/00*** | (2006.01) |
| ***B65H 5/06*** | (2006.01) |
| ***B65H 5/24*** | (2006.01) |
| ***B41J 13/10*** | (2006.01) |
| ***B65H 5/08*** | (2006.01) |

(52) U.S. Cl.

CPC ..... *B41J 11/04* (2013.01); *B41J 13/0009* (2013.01); *B41J 13/10* (2013.01); *B65H 5/068* (2013.01); *B65H 5/08* (2013.01); *B65H 5/24* (2013.01)

(58) Field of Classification Search

CPC .... B41J 11/0085; B41J 11/04; B41J 13/0009; B41J 13/0018; B41J 13/025; B41J 13/10; B41J 13/103; B41J 29/02; B65H 5/062; B65H 5/068; B65H 5/08; B65H 5/24; B65H 5/36

See application file for complete search history.

(56) References Cited

U.S. PATENT DOCUMENTS

| | | | | |
|---|---|---|---|---|
| 6,409,043 | B1 * | 6/2002 | Fujita | B65H 5/24 271/10.03 |
| 6,848,848 | B2 * | 2/2005 | Terao | B41J 13/0018 400/624 |
| 8,033,541 | B2 * | 10/2011 | Akiyama | B41J 13/0018 271/10.03 |
| 9,443,173 | B2 * | 9/2016 | Taguchi | B65H 29/66 |
| 2015/0251865 | A1 | 9/2015 | Nishida et al. | |

FOREIGN PATENT DOCUMENTS

| | | |
|---|---|---|
| JP | 2002-211789 A | 7/2002 |
| JP | 2015-168237 A | 9/2015 |

* cited by examiner

*Primary Examiner* — Anh T. N. Vo
(74) *Attorney, Agent, or Firm* — Workman Nydegger

(57) ABSTRACT

A printing device includes a printing unit, a pair of transporting rollers (a pair of rollers) that is disposed right before the printing unit and that transport a medium to the printing unit, and a transportation direction changing mechanism that is disposed on an upstream side of the pair of transporting rollers and that changes a transportation direction of the medium before the medium is nipped by the pair of transporting rollers. The transportation direction changing mechanism changes a transportation direction of a following medium such that a leading end portion of the following medium overlaps a preceding medium when the printing unit performs printing in a state where the preceding medium is nipped by the pair of transporting rollers.

9 Claims, 17 Drawing Sheets

PRINTING DEVICE

CROSS REFERENCES TO RELATED APPLICATIONS

The entire disclosure of Japanese Patent Application No. 2016-063958, filed Mar. 28, 2016 is expressly incorporated by reference herein.

BACKGROUND

1. Technical Field

The present invention relates to a printing device that can transport a preceding medium and a following medium while partially overlapping the mediums.

2. Related Art

In the related art, there is a known printing device that can transport a preceding medium (for example, a paper sheet (the same applies to the following)) and a following medium while partially overlapping the mediums for the purpose of improving throughput (for example, JP-A-2015-168237).

In the printing device described in JP-A-2015-168237, a trailing end portion of a preceding medium is pressed down by a lever so that a trailing portion of the preceding medium and a leading portion of a following medium overlap each other (refer to ST5 and ST6 in FIG. 2 of JP-A-2015-168237).

Incidentally, an operation of overlapping a preceding medium and a following medium is performed during printing on the preceding medium. In the related art, the trailing end portion of the preceding medium is pressed down by a lever in the overlapping operation so that the medium is bent. However, if the medium is bent while printing is being performed on the medium, stress based on the bending may be transmitted toward a leading portion of the medium and the state of a portion of the medium, on which printing is performed, may be changed (for example, positional deviation or distortion may occur). In addition, if the state of a portion of the medium, on which printing is performed, is changed during printing, printing quality decreases.

SUMMARY

An advantage of some aspects of the invention is that it is possible to suppress a decrease in printing quality with respect to transported mediums in a printing device in which a preceding medium and a following medium are transported while being overlapped.

Hereinafter, means of the invention and operation effects thereof will be described.

According to an aspect of the invention, there is provided a printing device including a printing unit that performs printing on a transported medium, a pair of rollers that is disposed right before the printing unit and that rotates while nipping the medium to transport the medium to the printing unit, and a transportation direction changing mechanism that is disposed on an upstream side of the pair of rollers and that changes a transportation direction of the medium before the medium is nipped by the pair of rollers, in which the transportation direction changing mechanism changes a transportation direction of a following medium such that the following medium overlaps a preceding medium when the printing unit performs printing in a state where the preceding medium is nipped by the pair of rollers.

According to this configuration, the preceding medium is not forcibly bent in a state of being nipped by the pair of rollers when the preceding medium and the following medium overlap each other. Therefore, an excessive stress is not likely to be applied to the preceding medium. Accordingly, it is possible to suppress a decrease in printing quality with respect to transported mediums in a printing device in which a preceding medium and a following medium are transported while being overlapped.

On the assumption that the pair of rollers is a first pair of rollers, the printing device preferably further includes a second pair of rollers that is disposed on an upstream side of a first pair of rollers and that transports the medium. The transportation direction changing mechanism is preferably a flap that is disposed on a downstream side of the second pair of rollers and is disposed right after the second pair of rollers. The flap preferably includes a surface that extends along a direction intersecting a tangential direction to the second pair of rollers and the surface preferably comes into contact with the medium which is transported being nipped by the second pair of rollers so that the transportation direction of the medium is changed.

According to this configuration, it is possible to change the transportation direction of the medium by bring a leading end of the medium which is transported being nipped by the second pair of rollers into contact with the surface of the flap which extends in the direction intersecting the tangential direction to the second pair of rollers. Accordingly, it is possible to simplify the configuration of the transportation direction changing mechanism since it is sufficient to provide such a flap.

On the assumption that the pair of rollers is a first pair of rollers, the printing device preferably further includes a second pair of rollers that is disposed on an upstream side of a first pair of rollers and that transports a medium. The transportation direction changing mechanism preferably includes a pair of nip contact controllable rollers which is disposed on a downstream side of the second pair of rollers and a nip contact control mechanism which establishes and disestablishes nip contact between the pair of nip contact controllable rollers.

According to this configuration, depending on whether the nip contact control mechanism establishes or disestablishes nip contact between the pair of nip contact controllable rollers, the pair of nip contact controllable rollers comes in contact with each other or not so that the transportation direction of the medium, which is transported being nipped by the second pair of rollers on the upstream side of the pair of nip contact controllable rollers, is changed.

In the printing device, the transportation direction changing mechanism is preferably constituted of a change guide which can switch a guide direction or a pair of change rollers which can switch a tangential direction at a nip point therebetween, and the change guide or the pair of change rollers preferably comes into contact with the transported following medium and changes a transportation direction of a leading end portion of the following medium such that the leading end portion of the following medium overlaps the preceding medium. According to this configuration, when the guide direction of the change guide or the tangential direction to the pair of change rollers is switched, the transportation direction of the medium is changed.

In the printing device, the transportation direction changing mechanism preferably changes the transportation direction of the following medium such that a leading end portion of the following medium overlaps the preceding medium via suctioning control of suctioning air in a space in which a trailing portion of the preceding medium and a leading portion of a following medium overlap each other, air sending control of sending air to the space in an ejecting manner, or electric charge control of electrically charging the medium moving in the space. According to this configuration, the transportation direction of the medium is changed in a non-contact manner via the suctioning control, the air sending control, or the electric charge control.

In the printing device, the flap is preferably supported to be rotatable around an axis which is parallel to an axial direction of the pair of rollers. According to this configuration, it is possible to change the transportation direction of the medium by rotating the flap.

In the printing device, the flap is preferably supported to be rotatable around the axis which is parallel to the axial direction of the pair of rollers and is preferably urged in a rotation direction thereof such that an intersection angle between the tangential direction to the second pair of rollers and the surface increases. According to this configuration, the degree of inclination of the flap changes according to the type of medium which comes into contact with the flap against the urging force acting on the flap. That is, the higher the rigidity of the medium is, the higher the degree of inclination of the flap is.

In the printing device, a flap rotation control device preferably changes an intersection angle between the tangential direction and the surface of the flap according to the type of medium. According to this configuration, the angle of the surface of the flap which relates to change in transportation direction of the medium can be changed in advance according to the type of medium by using the flap rotation control device.

In the printing device, the transportation direction changing mechanism preferably bends the medium into a waveform shape in a direction perpendicular to the transportation direction of the medium. According to the configuration, since the medium is bent into a waveform shape, the rigidity of the medium increases and thus the medium leaning downward and forward in the transportation direction is suppressed. Therefore, a direction in which the transportation direction changing mechanism guides the medium being deviated from a set direction is suppressed.

In the printing device, the transportation direction changing mechanism is preferably capable of switching a transportation direction of a leading end portion of the medium between an upward direction and a downward direction. According to this configuration, it is possible to switch between a transporting method in which the preceding medium is overlaid with the following medium and a transporting method in which the preceding medium is underlaid with the following medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 3:
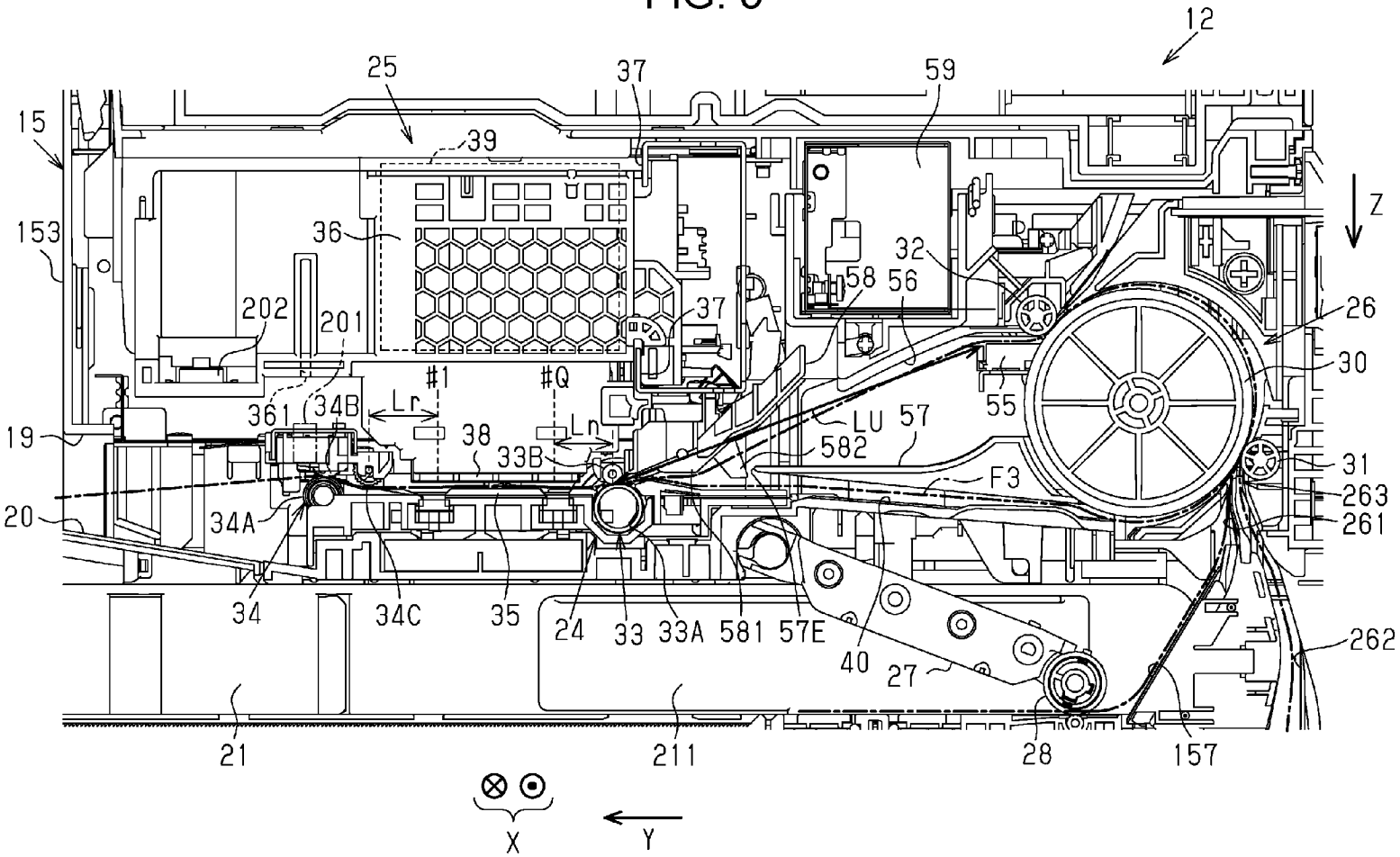
FIG. 3 is an enlarged sectional view of the multifunction machine.

Hereinafter, a multifunction machine including a printing device will be described with reference to the drawings. Note that, in a following description, a direction in which a printing unit moves during printing is referred to as "a scanning direction X (a width direction X)", a direction in which a medium disposed in a position facing the printing unit is transported is referred to as "a transportation direction Y", and a vertically downward direction is referred to as "a gravity direction Z". In addition, a direction in which the medium disposed in other places than the position facing the printing unit is transported is simply referred to as "a transportation direction" without a reference symbol "Y". In FIG. 3, a transportation route of the medium is denoted by using a one-dot chain line.

Figure 1:
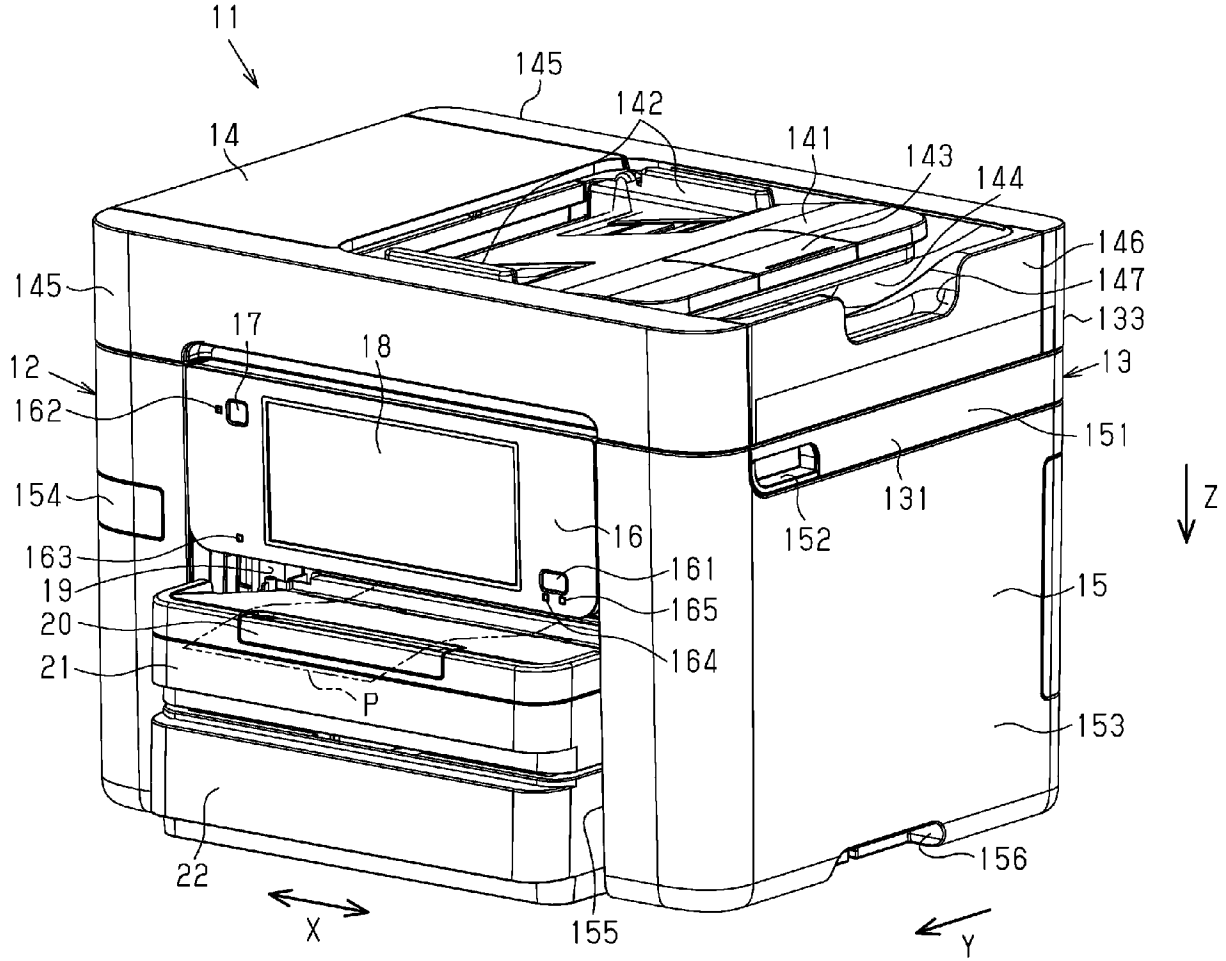
FIG. 1 is a perspective view of a multifunction machine.

As illustrated in FIG. 1, a multifunction machine 11 includes a printing device 12 which has a printing function, an image reading device 13 which has an image reading function, and an auto document feeding device 14 which feeds a document to the image reading device 13. The printing device 12 includes a rectangular parallelepiped-shaped main body 15, a main body lid portion 151 which is disposed such that the main body lid portion 151 can opens and closes an opening on an upper surface (not shown) of the main body 15. The image reading device 13 includes a scanner main body 131 which is configured in such a manner that a reading mechanism is built into the main body lid portion 151 and a lid portion 133 which rotates to open and close a document table 132 (refer to FIG. 2) that constitutes an upper surface portion of the scanner main body 131. The auto document feeding device 14 is installed onto the lid portion 133 and is rotated along with the lid portion 133 in an opening/closing direction. The lid portion 133 is movable along with the auto document feeding device 14 between a closing position in which the lid portion 133 covers the document table 132 and an opening position in which the document table 132 is exposed so that a document can be mounted on the document table 132.

A recessed grip portion 152 is provided on a front side (the downstream side in the transportation direction Y) of a side surface of the main body lid portion 151. When a user grips and lifts up the grip portion 152 so that the main body lid portion 151 rotates along with the image reading device 13 and the auto document feeding device 14 in an opening direction, the disposed position of the main body lid portion 151 is changed from the closing position illustrated in FIG. 1 to the opening position (not shown) in which un upper portion of the main body 15 is open. In a state where the main body lid portion 151 is disposed at the opening position, a printing mechanism in a housing 153, which constitutes the main body 15, is exposed and the user can perform a maintenance operation including an operation of replacing an ink receiving unit 39 (refer to FIG. 3) such as an ink cartridge, an operation of removing a jammed medium, and the like.

The auto document feeding device 14 illustrated in FIG. 1 includes a document mount table 141 on which a plurality of documents can be set, a pair of document edge guides 142 which is operated when positioning a document set on the document mount table 141 in the width direction, and a document support 143 which can support a portion of a document which protrudes from the document mount table 141.

A document discharging portion 144, to which a document fed by the auto document feeding device 14 is discharged after the document is scanned by the image reading device 13, is provided below the document mount table 141. The auto document feeding device 14 includes a pair of wall portions 145 which is disposed on the opposite sides of the document mount table 141 while interposing the document mount table 141 in a direction intersecting the transportation direction of the document, and a side plate 146 which is disposed to face a discharging port of the document discharging portion 144. Accordingly, the document discharging portion 144 is surrounded by the pair of wall portions 145, the document mount table 141, and the side plate 146. The side plate 146 is provided with a recess 147 with which the user confirms the document discharged to the document discharging portion 144. Therefore, it is possible to confirm the document discharged to the document discharging portion 144 via the recess 147 and it is possible to pick up the discharged document via the recess 147. Note that, the document support 143 may be a transparent member. If the document support 143 is a transparent member, even in a case where a document with a small size (for example, A6) is scanned by using the auto document feeding device 14, it is possible to confirm that the document with the small size is discharged to the document discharging portion 144 via the transparent document support 143. Therefore, it is possible to prevent the user from forgetting to pick up the document.

As illustrated in FIG. 1, a rectangular operation panel 16 which includes a power button 17 and a touch-panel type display unit 18 is provided on an upper portion of the front surface of the printing device 12. The operation panel 16 is provided with an operation button 161, a power LED 162, a FAX reception LED 163, a printing job reception LED 164, and an error notification LED 165 in addition to the above-described components. The operation button 161 functions as a cancel button during printing and functions as a copy button during a printing-standby state. In a case where the operation button 161 is operated as the copy button and a sensor (not shown) detects that the document is mounted on the document mount table 141, the auto document feeding device 14 is driven and the fed document is scanned. Meanwhile, in a case where the sensor detects nothing and the document is not mounted on the document mount table 141, the document mounted on the document table 132 is scanned. Note that, the main body 15 is provided with a lid portion 154 for an USB slot (not shown) which is disposed beside the operation panel 16.

In addition, a discharging port 19 which discharges a medium P on which printing has been performed and a slide-type discharging stacker 20 which receives the medium P discharged from the discharging port 19 are provided below the operation panel 16 of the printing device 12. The discharging stacker 20 can be manually operated to be moved between an accommodation position illustrated in FIG. 1 and an unfolding position illustrated in FIG. 2 in a sliding manner. In addition, a cassette receiving portion 155 is provided below the discharging stacker 20 of the housing 153 of the main body 15. The cassette receiving portion 155 is constituted by an accommodation space of which the front side opens and which extends inward. Two upper and lower cassettes 21 and 22 which can receive a plurality of mediums P are mounted into the cassette receiving portion 155 such that the cassettes 21 and 22 can be inserted into and extracted from the cassette receiving portion 155. Note that, bottom portions of opposite side surfaces of the main body 15 are respectively provided with recessed handle portions 156 (only one of those is described in FIG. 1) which the user can grip when lifting up the multifunction machine 11.

Figure 2:
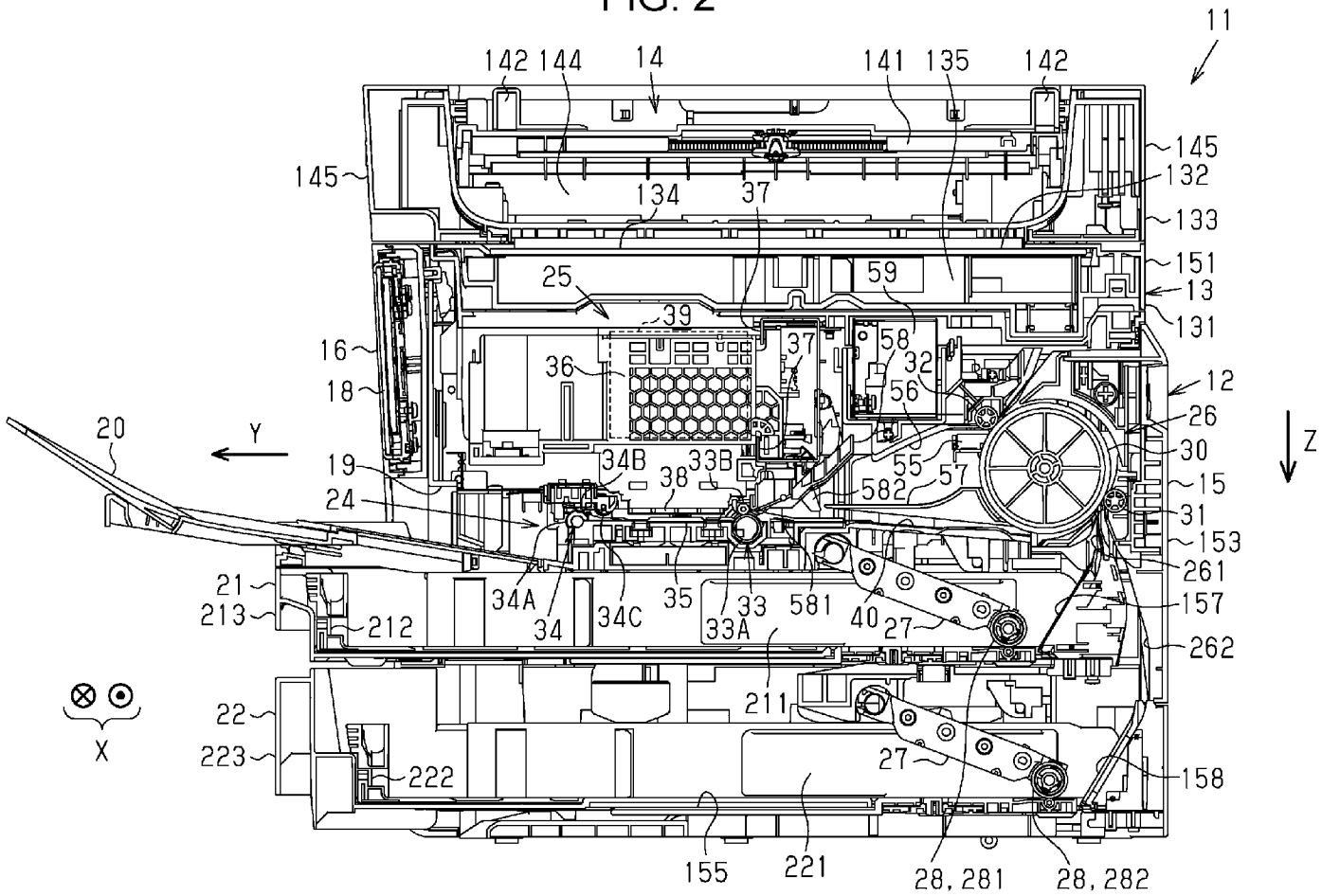
FIG. 2 is a sectional view of the multifunction machine.

Next, an internal configuration of the multifunction machine 11, particularly an internal configuration of the printing device 12 will be described with reference to FIGS. 2 and 3. As illustrated in FIG. 2, in the housing 153, a transporting mechanism 24 that transports the medium P and the printing unit 25 which performs printing on the transported medium P is accommodated. The transporting mechanism 24 includes a feeding mechanism 26 which feeds the medium P in the cassettes 21 and 22 to the printing unit 25 one by one. The feeding mechanism 26 includes arm members 27 each of which is supported to be rotatable around a proximal end portion thereof being disposed at a position corresponding to an insertion position of each of the cassettes 21 and 22 in the main body 15 and feeding rollers 28 (pick up rollers) each of which is provided on a distal end portion of each arm member 27. Note that, hereinafter, in a case where the feeding roller 28 on the first cassette 21 side and the feeding roller 28 on the second cassette 22 side are distinguished, the feeding roller 28 on the first cassette 21 side is denoted by using a reference numeral 281 and the feeding roller 28 on the second cassette 22 side is denoted by using a reference numeral 282.

In addition, the cassettes 21 and 22 include side end edge guides 211 and 221 which can position the medium P in the width direction while coming into contact with the opposite side ends in the width direction of the mounted (set) medium P, trailing end edge guides 212 and 222 which can position a trailing end of the medium P while coming into contact with an end portion (the trailing end) of the medium P on the upstream side in a feeding direction and claw portions which can position a leading end of the medium P while coming into contact with an end portion (the leading end) of the medium P on the downstream side in the feeding direction. The medium P set in the cassettes 21 and 22 is held in the cassettes 21 and 22 when the leading end thereof comes into contact with the claw portion. Note that, the claw portion is disposed at a position in which the claw portion does not come into contact with the feeding roller 28 when the cassettes 21 and 22 are inserted.

The arm member 27 is urged (not shown) in a clockwise direction in FIG. 2 by a spring. When the cassettes 21 and 22 are inserted into the cassette receiving portion 155, the arm member 27 is rotated in a counter clockwise direction once and then returns to a position before the rotation due to the urging force so that the feeding roller 28 comes into contact with the uppermost one medium P of the plurality of mediums P in the cassette 22 with a predetermined urging force.

As illustrated in FIG. 2, on the inner side (the right side in FIG. 2) of the cassette receiving portion 155 of the main body 15, inclined separating plates 157 and 158 (separating wall portions) are disposed at positions facing end portions in the feeding direction (right in FIG. 2) of the cassettes 21 and 22, respectively. Even in a case where the plurality of mediums P are fed by the feeding roller 28, the uppermost one medium P of the plurality of mediums P is separated from the plurality of mediums P and fed toward the downstream side in the feeding direction while sliding on a surface of the separating plate 157 or the separating plate 158. As described above, in the first embodiment, as a separation method of separating one medium P from the mediums P, a wall separation method is used. Note that, instead of the wall-separation method, a roller-separation method in which the mediums P pass through a pair of rollers for separation so that one medium P is separated from the mediums P may be used.

In addition, as illustrated in FIG. 2, the feeding mechanism 26 includes transporting paths 261 and 262 to each of which the medium P fed from each of the cassettes 21 and 22 is transported via each of the separating plates 157 and 158. The two transporting paths 261 and 262 join each other above the separating plate 157 of the upper cassette 21. Note that, hereinafter, the upper (at the first stage) cassette 21 is also referred to as "the first cassette 21" and the lower (at the second stage) cassette 22 is also referred to as "the second cassette 22".

As illustrated in FIG. 2, the transporting path 262 to which the medium P from the lower second cassette 22, which is disposed below the upper first cassette 21, is transported is offset in a depth direction (right in FIG. 2) so as to be separated from the first cassette 21. Although front end portions 213 and 223 on extraction sides of the first cassette 21 and the second cassette 22 are flush with each other, the trailing end edge guide 222, the feeding roller 282, and the separating plate 158 of the second cassette 22 are offset from the trailing end edge guide 212, the feeding roller 281, and the separating plate 157 of the first cassette 21 in the depth direction, respectively.

In addition, as illustrated in FIG. 2, the feeding mechanism 26 includes an intermediate roller 30 with a large diameter which is disposed obliquely above a junction 263 (refer to FIG. 3) of the two transporting paths 261 and 262 and a first driven roller 31 with a small diameter and a second driven roller 32 with a small diameter which abut on an outer peripheral surface of the intermediate roller 30. The medium P which is fed from one of the cassettes 21 and 22, which is selected, reaches the junction 263 through one of the transporting paths 261 and 262, which corresponds to the one of the cassettes 21 and 22, and is transported from the junction 263 through a path along an outer periphery of the intermediate roller 30 being nipped between the intermediate roller 30 and the two driven rollers 31 and 32 when the intermediate roller 30 rotates. Then, the medium P is fed toward a pair of transporting rollers 33 (a first pair of rollers) from a nip point between the intermediate roller 30 and the second driven roller 32.

In addition, as illustrated in FIGS. 2 and 3, a guide member 55 as a transportation direction changing mechanism 70, which guides the medium P fed from the nip point to change the feeding direction of the medium to a target direction, is disposed at a position right after the nip point between the intermediate roller 30 and the second driven roller 32 in the transportation direction being disposed on the downstream side of the nip point. During feeding of the medium P, the medium P fed from the nip point between the intermediate roller 30 and the second driven roller 32 is guided toward the downstream side in a substantially horizontal direction along an upper surface (an abutting surface 72 which will be described later) of the guide member 55, reaches an inclined ceiling wall portion 56, and is transported along an inclined surface of the ceiling wall portion 56 through a path which extends obliquely below while maintaining the upper limit height. In addition, a supporting member 57, which supports a portion of the medium P leaning downward when the fed medium P leans downward from the guide member 55 or supports the trailing end portion of the medium P after the medium P falls from the guide member 55, is disposed between the intermediate roller 30 and the pair of transporting rollers 33.

As illustrated in FIG. 3, the supporting member 57 includes a recessed curved surface of which the height is lowered from the upstream side toward the downstream side in the transportation direction in an upper surface which supports the medium P, and a portion of the supporting member 57 on the downstream side of the recessed curved surface in the transportation direction is a flat surface which extends substantially horizontally. In addition, the supporting member 57 includes the protruding end portion 57E at an end portion thereof on the downstream side of the transportation direction. The protruding end portion 57E of the supporting member 57 is a branch between a feeding path which forms a downward path that guides the medium P fed from the cassettes 21 and 22 to the pair of transporting rollers 33 and a reversing path 40 that guides the medium P, which is reversely transported from the pair of transporting rollers 33 after printing is performed on one surface thereof and which is the target of duplex printing, to the intermediate roller 30.

As illustrated in FIGS. 2 and 3, the transporting mechanism 24 includes the pair of transporting rollers 33, which transport the medium P fed from the feeding mechanism 26 through a path that passes through a printing region in which the printing unit 25 can perform printing, and a pair of discharging rollers 34 which discharges the medium P on which the printing unit 25 has performed the printing. At a position on the slightly upstream side in the transportation direction Y of the pair of transporting rollers 33, an elongated swing member 58 is disposed while being urged in a counter clockwise direction in FIGS. 2 and 3 by a spring (not shown) and being in a standby-position in which the swing member 58 is inclined in an oblique direction in FIGS. 2 and 3. The swing member 58 includes a pressurization rib 581 which protrudes downward and a flap portion 582. The pressurization rib 581 has a function of urging downward the trailing end portion of the medium P and suppressing the rising of the trailing end portion of the medium P.

Here, a protruding end portion of the pressurization rib 581 which can come into contact with the medium P is positioned being offset from a virtual line connecting a nip point between the pair of transporting rollers 33 and a protruding end portion 57E of a supporting member 57 in the downward direction (the gravity direction Z). Although it is ideal that the protruding end portion of the pressurization rib 581 is positioned on the virtual line, considering the manufacturing tolerance, the protruding end portion of the pressurization rib 581 is caused to be offset from the virtual line in the downward direction while urging the pressurization rib 581 downward by using spring load of the swing member 58 in order to avoid a problem that occurs in a case where the protruding end portion is offset from the virtual line in the upward direction.

In addition, as illustrated in FIGS. 2 and 3, a support table 35 which can support the medium P that is transported along the transportation route is disposed at a position between the pair of transporting rollers 33 and the pair of discharging rollers 34 in the transportation direction Y. The pair of transporting rollers 33 includes a transporting driving roller 33A and a transporting driven roller 33B that can rotate in accordance with rotation of the transporting driving roller 33A. In addition, the pair of discharging rollers 34 includes a discharging driving roller 34A and a discharging driven roller 34B that can rotate in accordance with rotation of the discharging driving roller 34A. In addition, a pressurization roller 34C, which presses down the leading end portion of the medium P from above before the medium P is nipped by the pair of discharging rollers 34 so as to suppress the rising of the leading end portion, is disposed at a position between the pair of discharging rollers 34 and the support table 35 in the transportation direction Y.

As illustrated in FIGS. 2 and 3, the printing unit 25 includes a carriage 36 that is held at a position above the support table 35 so that the carriage 36 can reciprocate in the scanning direction X being guided by guide rail portions 37 and a printing head 38 which is mounted being close to a surface of the carriage 36 that faces the support table 35. The carriage 36 is supported at two positions by a pair of upper and lower guide rail portions 37 and is guided in a state of being positioned in the transportation direction Y and the gravity direction Z and in a state of being movable in the scanning direction X. A plurality of ink receiving units 39 of which the number is equal to the number of ink colors are mounted on the carriage 36. The printing head 38 discharges ink, which is supplied from the ink receiving unit 39 mounted on the carriage 36, toward the medium P while moving in the scanning direction X. Therefore, each time the medium P which is intermittently transported during the printing stops, the printing head 38 prints one line. The medium P after printing is discharged from the discharging port 19 with the pair of discharging rollers 34 or the like rotating, and is stacked on the discharging stacker 20. When the user slides the discharging stacker 20 in the transportation direction from the accommodation position shown in FIG. 1 so that the discharging stacker 20 protrudes and the user rotates a distal end portion of the discharging stacker 20, the discharging stacker 20 is unfolded and enters a state for use shown in FIG. 2. Note that, although the ink receiving unit 39 in the first embodiment is constituted of an ink cartridge, the ink receiving unit 39 may be an adapter to which ink is supplied from an ink tank (not shown), which is attached to an internal portion or an outer portion of the main body 15, through an ink tube (not shown) and which can temporarily store the ink.

In addition, the printing device 12 of the first embodiment has a duplex printing function. The reversing path 40 (a switchback path) is provided in the main body 15. Through the reversing path 40, the medium P, which is transported in the transportation direction Y and of which one surface has been subjected to printing performed by the printing unit 25, is reversely transported in a direction opposite to the transportation direction Y and is guided to the junction 263. The reversing path 40 is a path extending below the supporting member 57 and joins the junction 263 of the transporting paths 261 and 262. The medium P of which one surface (a front surface) has been subjected to the printing is reversely transported along a transportation route F3 passing through the reversing path 40, reaches the junction 263, and is introduced from the junction 263 to a nip point between the intermediate roller 30 and the first driven roller 31. Specifically, when the medium P passes through the reversing path 40, the flap portion 582 guides the medium P in a switchback operation downward so that the medium P is guided to the reversing path 40. When the leading end of the medium P comes into contact with the flap portion 582 in a direction from the upstream side to the downstream side, the flap portion 582 rotates toward the downstream side in the transportation direction Y and thus the medium P is not restricted. Meanwhile, even if the leading end of the medium P comes onto contact with the flap portion 582 in a direction from the downstream side to the upstream side when the medium P is subject to the switchback operation so that the printing is performed on the other surface (a rear surface), the flap portion 582 does not rotate and guides the medium P after the switchback operation to the reversing path 40.

In addition, the front and back of the medium P are reversed when the medium P is transported along the outer periphery of the intermediate roller 30 and the medium P is transported to the printing unit 25 through the pair of transporting rollers 33 with the other surface facing the printing head 38. Then, the printing unit 25 performs printing on the other surface (the rear surface) of the medium P. In this manner, duplex printing on the medium P is performed. The medium P after the duplex printing is stacked on the discharging stacker 20.

In addition, as illustrated in FIG. 2, the image reading device 13 is a flat head type scanner device and includes the document table 132 which includes a document mount glass plate 134 and a scanner carriage 135 which can reciprocate below the document mount glass plate 134 along the scanning direction X. In addition, as illustrated in FIGS. 2 and 3, in the main body 15, a power unit 59 is provided above the transportation route. The power unit 59 converts power from a commercial AC power supply to DC power and supplies power required for driving to the printing device 12, the image reading device 13, and the auto document feeding device 14.

As illustrated in FIG. 3, in the main body 15, a remaining amount sensor 201 which detects the amount of remaining ink in the ink receiving unit 39 is provided at a position on the downstream side in the transportation direction Y of the support table 35. One remaining amount sensor 201 is disposed in a predetermined position in the scanning direction X. In the carriage 36, a plurality of detecting target holes 361 are provided at positions in which the detecting target holes 361 can face the remaining amount sensor 201 in a state of being arranged in a row along the scanning direction X. Ink from each ink receiving unit 39 is supplied to the printing head 38 via the upper side of the detecting target hole 361. When the hole 361 is positioned above the remaining amount sensor 201 in response to the movement of the carriage 36 in the scanning direction X, the remaining amount sensor 201 detects ink from the ink receiving unit 39 corresponding to the hole 361 via the hole 361 and when there is ink, the remaining amount sensor 201 enters a non-detection state and when there is no ink, the remaining amount sensor 201 enters a detection state. The plurality of holes 361 needs to be arranged in a row along the scanning direction X in order for the holes 361 to be detected by the remaining amount sensor 201. The carriage 36 is provided with an adjustment dial 202 illustrated in FIG. 3 and it is possible to rotate the carriage 36 around an axis along the gravity direction Z and to adjust the attitude angle of the carriage 36 by operating the adjustment dial 202. It is possible to arrange the plurality of holes 361 in a row along the scanning direction X by adjusting the attitude angle of the carriage 36 so that all of the plurality of holes 361 can be detected by the remaining amount sensor 201.

In the printing device 12 of the first embodiment, one of a plurality of kinds of feeding methods is selected according to printing conditions based on a printing job. When the printing device 12 receives a printing job with conditions of a normal paper sheet, band printing, and one-side printing, the printing device 12 selects an overlap-feeding method which accompanies an overlap-consecutive feeding operation of transporting the preceding medium P and the following medium P together to a printing start position of the following medium P while maintaining a state where the preceding medium P and the following medium P partially overlap each other. When the printing device 12 receives a printing job with other conditions, the printing device 12 selects a normal feeding method of transporting the following medium P to the printing start position in a state where an interval is provided between the preceding medium P and the following medium P. When the overlap-feeding method is selected, an overlapping operation of causing the leading end portion of the following medium, which is the medium P transported later than the preceding medium, to overlap the trailing end portion of the preceding medium, which is the medium P transported earlier, is performed and then, when printing on the preceding medium is finished, the overlap-consecutive feeding operation of transporting the preceding medium and the following medium together to the printing start position of the following medium while maintaining a overlapped state of the preceding medium and the following medium at that time. In addition, before and after the overlap-consecutive feeding operation, a skew correction operation of correcting skew of the leading end of the following medium by bring the leading end of the following medium into contact with the pair of transporting rollers 33 is performed. Note that, even in a case where the overlap-feeding method is selected, the overlap-consecutive feeding operation is performed only when conditions for overlapping of the preceding medium and the following medium which will be described later are satisfied.

In addition, overlapping methods in the overlapping operation includes an overlaying operation of overlaying the trailing end portion of the preceding medium with the leading end portion of the following medium and an underlaying operation of underlaying the trailing end portion of the preceding medium with the leading end portion of the following medium. The overlapping operation of the first embodiment is performed by using the overlaying method. Accordingly, it is necessary to overlay the trailing end portion of the preceding medium with the leading end portion of the following medium. In this regard, the guide member 55 changes the feeding direction of the medium P which is fed from the nip point between the intermediate roller 30 and the second driven roller 32 to a guide direction in which the preceding medium is likely to be overlaid and which extends obliquely upward such that the preceding medium and the following medium overlap in the proper order in the overlapping operation. The medium P which is fed at a predetermined feeding speed from the last nip point of the intermediate roller 30 is caused to slide on the upper surface of the guide member 55 so that the feeding direction thereof is changed to an approximately horizontal direction and the medium P which has been fed in the approximately horizontal direction is transported along the inclined surface of the ceiling wall portion 56 toward the pair of transporting rollers 33 while maintaining the upper limit position. Therefore, the overlaying operation of overlaying an upper portion (on the printing surface side) of the preceding medium with the following medium succeeds more frequently.

The posture of guide member 55 shown in FIG. 3 may be fixed to a posture (for example, a horizontal posture) with which the guide member 55 can guide the medium P in the feeding direction at the time of the overlapping operation. However, it is not preferable that resistive load be applied to the medium P during transportation when the overlapping operation is not performed and the feeding direction is changed to an oblique upward direction. Therefore, it is preferable that the guide member 55 be provided to be capable of being displaced between a guide position (a first position which is shown in FIG. 3) in which the guide member 55 takes a posture for guiding the medium P at the time of the overlapping operation and a withdrawal position (a second position) in which the guide member 55 takes a posture for not guiding the medium P a posture for decreasing the load acting on the guided medium P except for the time of the overlapping operation.

In a case where the guide member 55 is provided to be capable of being displaced, regarding the displacement directions of the guide member 55, the following two schemes can be exemplified. The guide position of the guide member 55 is the same for the two schemes. The guide member 55 is disposed at the guide position in which the medium P is sent toward the downstream side in the transportation direction Y and the horizontal direction as far as possible and the guide member 55 takes a posture (for example, the horizontal posture) for simplifying overlaying the preceding medium with the following medium. In addition, one scheme is a rotation scheme in which the guide member 55 rotates between the withdrawal position in which the guide member 55 takes an oblique downward posture with an end portion thereof on the upstream side as the fulcrum and the above-described guide position. The other scheme is a slide scheme in which the guide member 55 protrudes in the route while taking the horizontal posture as in the rotation scheme in the guide position and the guide member 55 does not protrude in the route while taking the horizontal posture in the withdrawal position and the guide member 55 moves between the withdrawal position and the guide position in the horizontal direction (the transportation direction Y) in a sliding manner.

In addition, as a mechanism which displaces the guide member 55, a mechanism in which the guide member 55 is held at the guide position by using an urging force of a spring (spring load) and the guide member 55 is displaced to the withdrawn direction when the spring load is lower than the stiffness of the medium P according to the stiffness (that is, the rigidity) of the medium P. For example, in a case of the medium P which is formed of a thick paper sheet such as a photographic paper sheet, displacement magnitude when the guide member 55 is displaced to the withdrawal position since the spring load is lower than the stiffness of the medium P is relatively high and in a case of the medium P which is formed of a thin paper sheet such as a normal paper sheet, displacement magnitude when the guide member 55 is withdrawn is relatively small since the stiffness of the medium P is small. As described above, the guide member 55 is withdrawn by the displacement magnitude according to the stiffness of the medium P and thus it is possible to reduce the load from the guide member 55 to the medium P. Note that, a mechanism which displaces the guide member 55 by using the spring load can be applied to both of the rotation scheme and the slide scheme.

In addition, the mechanism which displaces the guide member 55 can be also realized by using a power source such as a solenoid or an electric motor. That is, the guide member 55 is displaced between the guide position and the withdrawal position by using power from the power source. The mechanism using the power source can be applied to both of the rotation scheme and the slide scheme.

In addition, the reason that the protruding end portion of the pressurization rib 581 illustrated in FIG. 3 is offset from the virtual line connecting the nip point between the pair of transporting rollers 33 and the protruding end portion 57E of the supporting member 57 in the downward direction is as follows.

In a case where the protruding end portion of the pressurization rib 581 is positioned above the virtual line, the trailing end of the preceding medium rises, and the leading end portion of the following medium is hindered from overlapping the trailing end portion of the preceding medium (Reason 1). In addition, in a case where the protruding end portion of the pressurization rib 581 is positioned below the virtual line, since the preceding medium is pressed down by the protruding end portion of the pressurization rib 581 to be held at a position below the virtual line, a portion of the preceding medium, which is on the slightly upstream side of a portion of the preceding medium which is pressed down, is pressed down by the protruding end portion 57E of the supporting member 57. As a result, a portion of the preceding medium which is positioned on the upstream side of the protruding end portion 57E rises. Even in this case, the leading end portion of the following medium is hindered from overlapping the trailing end portion of the preceding medium (Reason 2).

In addition, in a case where the protruding end portion of the pressurization rib 581 is positioned below the virtual line, the leading end of the medium P which is pressed down by the protruding end portion of the pressurization rib 581 comes in contact with the transporting driving roller 33A, which is one of the pair of transporting rollers 33 and which is subject to a slip-proof treatment in which aluminum powders or the like is applied thereto, and due to slip proof action at the contact point, the medium P is restricted from sliding toward the nip point between the pair of transporting rollers 33. Therefore, an assumed skew correction operation becomes unable (Reason 3).

When the printing device is designed into an ideal shape so that the protruding end portion of the pressurization rib 581 is positioned on the virtual line, there is a concern that above-described problems may occur. Accordingly, a problem attributable to Reason 1 is solved by designing the printing device so that the protruding end portion of the pressurization rib 581 is positioned below the virtual line. In addition, the pressurization rib 581 is urged downward by the spring load and can be operated upward due to the stiffness of the medium P. In this manner, problems attributable to Reason 2 and Reason 3 are solved.

In addition, the skew correction operation of correcting the skew of the medium P is performed with the posture of the medium P transitioning from State 1 to State 5 (which are described below) sequentially. First, the medium P is transported toward the downstream side while being guided by the guide member 55 along the ceiling wall portion 56 (State 1). Next, the leading end of the medium P comes into contact with the pair of transporting rollers 33 in a stationary state and the intermediate roller 30 applies a transporting force toward the downstream side to the medium P even after the contact (State 2). Then, since the intermediate roller 30 applies the transporting force in a state where a portion of the stopped medium P is in contact with the ceiling wall portion 56, a portion of the medium P on the downstream side of the contact position bends downward (State 3). As the bent portion of the medium P grows, a portion of the medium P which is in contact with the ceiling wall portion 56 moves gradually toward the upstream side and thus the bent portion further grows (State 4) (refer to FIG. 8A). In addition, a force of the grown bent portion causes an edge side of the leading end of the medium P to be aligned with the pair of transporting rollers 33 so that the skew of the medium P is corrected (State 5). The medium P of which the skew is corrected is transported to the pair of transporting rollers 33 so that printing is performed on the medium P of which the skew is corrected.

Here, the conditions for overlapping will be described. In a case where the overlap-feeding method is selected, it is determined whether the conditions for overlapping are satisfied or not in the printing device 12. The overlap-consecutive feeding operation is allowed to be performed in a case where the conditions for overlapping are satisfied. The conditions for overlapping include margin conditions which are conditions for the overlap-consecutive feeding operation of the trailing end margin length (bottom margin) of the preceding medium and the leading end margin length (top margin) of the following medium. Regarding the margin conditions, in a case where any of a condition that the trailing end margin length of the preceding medium is within a range of approximately 30 mm to approximately 80 mm and a condition that the leading end margin length of the following medium is equal to or greater than approximately 15 mm is satisfied, the overlap-consecutive feeding operation is allowed to be performed.

Regarding the margin conditions, in a case where both of the trailing end margin length of the preceding medium and the leading end margin length of the following medium satisfy the following conditions, the overlap-consecutive feeding operation is allowed to be performed. Here, as illustrated in FIG. 3, a distance between the nip point between the pair of transporting rollers 33 and a downstream end of the guide member 55 is denoted by LU, a distance between the nip point between the pair of transporting rollers 33 and an uppermost stream nozzle #Q is denoted by Ln, and a distance between a lowermost stream nozzle #1 and the pressurization roller 34C is denoted by Lr. The first condition is that the trailing end margin length of the preceding medium is within a range of "distance Ln+α to distance LU". Here, the leading end portion of the following medium overlaps a portion corresponding to α in "distance Ln+α". The second condition is that the leading end margin length of the following medium is equal to or greater than the distance Lr. By reducing the distance Lr or the distance LU in FIG. 3, it is possible to reduce the margin length required for the overlap-consecutive feeding operation. Note that, the distance Ln+α may be replaced with "2×Ln" which is a value that is two times the distance Ln, for simplification.

The reason that the trailing end margin length of the preceding medium needs to be at least 30 mm is as follows. That is, the distance Ln between the uppermost stream nozzle #Q of the printing head 38 and the nip point between the pair of transporting rollers 33 is, for example, approximately 13 mm, and the length required for a region, in which the leading end portion of the following medium overlaps the preceding medium and which extends from the nip point between the pair of transporting rollers 33 toward the upstream side in the transportation direction Y, is approximately 15 mm. When these values are summed up, approximately 28 mm is obtained. Furthermore, considering the manufacturing error in length in the transportation direction Y of the medium P to some extent, the trailing end margin length of the preceding medium needs to be at least approximately 30 mm.

In addition, the reason that the trailing end margin length of the preceding medium is equal to or smaller than 80 mm is as follows. That is, the distance LU between the nip point between the pair of transporting rollers 33 and the downstream end in the transportation direction Y of the guide member 55 is approximately 80 mm. Therefore, if the trailing end margin length is larger than 80 mm, the trailing end of the preceding medium reaches the guide member 55 and it is not possible to cause the leading end of the following medium to overlap the preceding medium.

The reason that the leading end margin length of the following medium needs to be approximately 15 mm is as follows. That is, the distance Lr between the lowermost stream nozzle #1 of the printing head 38 and the pressurization roller 34C is approximately 14 mm, and considering the manufacturing error to some extent, the leading end margin length of the following medium needs to be approximately 15 mm. In addition, the reason that the leading end margin length of the following medium needs to be approximately 15 mm is as follows. That is, if the leading end of the following medium is not pressed down before printing (discharging of ink) on the following medium is started, the medium P curls toward the printing head 38 side when the ink is discharged, and friction occurs between the medium P and the printing head 38. Therefore, the leading end portion of the medium P which corresponds to an area from the lowermost stream nozzle #1 to the pressurization roller 34C of the printing head 38 is left blank. Incidentally, the overlapping amount of the preceding medium and the following medium changes according to the trailing end margin length of the preceding medium. That is, in a case where the trailing end margin length of the preceding medium is 30 mm which is the shortest length, approximately 17 mm which is a value obtained by subtracting approximately 13 mm, which is the distance between the uppermost stream nozzle #Q of the printing head 38 and the nip point between the pair of transporting rollers 33, from 30 mm is the overlapping amount of the preceding medium and the following medium.

In addition, in a case where the trailing end margin length of the preceding medium is 80 mm which is the longest length, approximately 67 mm which is a value obtained by subtracting approximately 13 mm, which is the distance between the uppermost stream nozzle #Q of the printing head 38 and the nip point between the pair of transporting rollers 33, from 80 mm is the overlapping amount of the preceding medium and the following medium. As described above, the overlapping amount of the preceding medium and the following medium changes within a range of approximately 17 mm to approximately 67 mm according to the trailing end margin length of the preceding medium.

A configuration of a transporting unit in a section from the feeding roller 28 to the pair of discharging rollers 34 (the first pair of rollers) in the transporting mechanism 24 will be described with reference to FIG. 4.

The transporting unit in the section in the transporting mechanism 24 is provided with the intermediate roller 30, two driven rollers 31 and 32 which rotate in accordance with rotation of the intermediate roller 30 with the medium P interposed therebetween, the transportation direction changing mechanism 70, and the pair of transporting rollers 33 and the pair of discharging rollers 34 which are disposed on the downstream side of the transportation direction changing mechanism 70 in the transportation route of the medium P. The transportation direction changing mechanism 70 is disposed on the downstream side of the two driven rollers 31 and 32 in the transportation route. Note that, the second driven roller 32 and the intermediate roller 30 constitute a second pair of rollers 69 which is disposed on the upstream side of the pair of transporting rollers 33 and transport the medium P.

Figure 4:
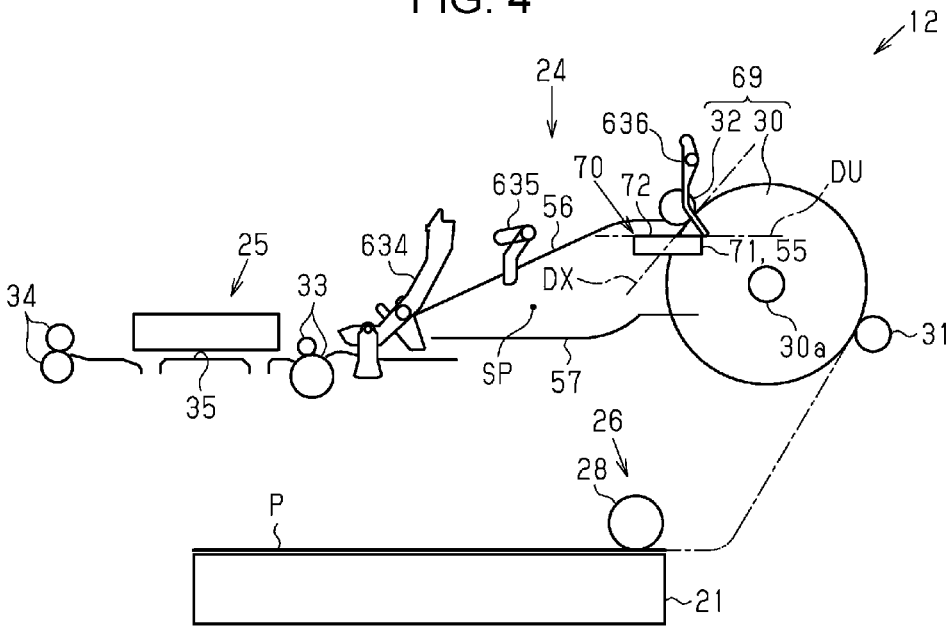
FIG. 4 is a schematic view of a printing device according to a first embodiment.

As illustrated in FIG. 4, the intermediate roller 30 is disposed above the feeding roller 28.

The diameter of the first driven roller 31 and the diameter of the second driven roller 32 are smaller than the diameter of the intermediate roller 30. The first driven roller 31 and the second driven roller 32 are disposed around the intermediate roller 30. The first driven roller 31 is disposed close to the feeding roller 28 in the transportation route. The second driven roller 32 is disposed on the downstream side of the first driven roller 31 in the transportation route, disposed above a rotation shaft 30*a* of the intermediate roller 30, and disposed closer to the pair of transporting rollers 33 than the rotation shaft 30*a* of the intermediate roller 30.

The pair of transporting rollers 33 is disposed on the upstream side of the printing unit 25 in the transportation route of the transporting mechanism 24 and is disposed below the second driven roller 32. In addition, the axes of the pair of transporting rollers 33 and the axis of the second driven roller 32 are separated from each other by a predetermined distance. The predetermined distance in this case is smaller than at least the length of the medium P (the transverse length in the transportation direction). This is because of skew correction of the medium P. That is, the skew correction is performed by driving the intermediate roller 30 in a state where the leading end of the medium P is in contact with the pair of transporting rollers 33 and the trailing portion of the medium P is nipped by the intermediate roller 30 and the second driven roller 32 so that the medium P is pushed forward.

The transportation direction changing mechanism 70 includes the above-described guide member 55. The guide member 55 is configured as, for example, a flap 71 which rises up the leading end of the medium P.

The flap 71 guides the medium P which is transported by the intermediate roller 30 and the second driven roller 32 to a position above a tangent line DX to the intermediate roller 30 and the second driven roller 32.

Figure 5:
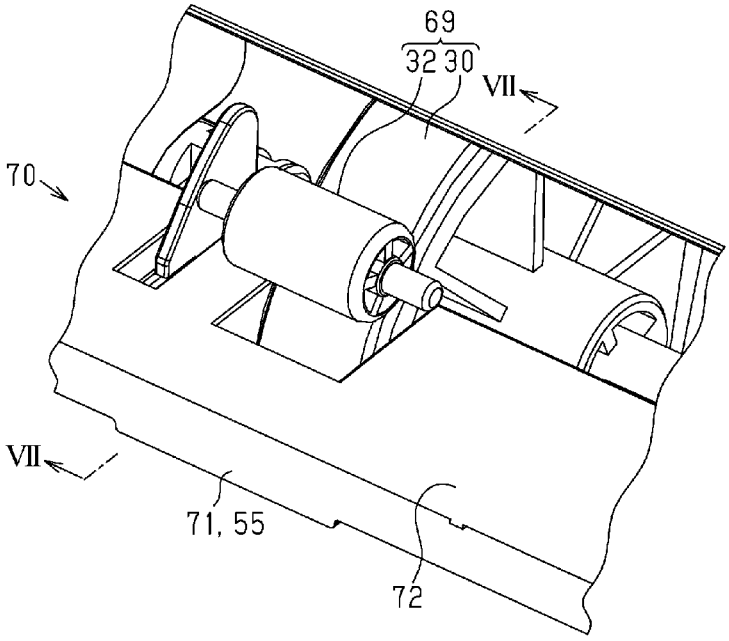
FIG. 5 is a perspective view of a flap and the vicinity of the flap.

As illustrated in FIG. 5, for example, the flap 71 includes an abutting surface 72 onto which the medium P abuts. The abutting surface 72 is configured into a flat surface or a curved surface. Note that, the flap 71 may be constituted by a plurality of poles. In this case, each pole is disposed such that the longitudinal direction thereof is parallel to a transportation guide direction.

The flap 71 is disposed right after the second driven roller 32 (the downstream side in the transportation route). A line (hereinafter, referred to as "the line DU on the flap 71") which is extended from a line along the upper side of a section of the flap 71 intersects the tangent line DX to the intermediate roller 30 and the second driven roller 32, the section being perpendicular to the rotation shaft 30*a* of the intermediate roller 30. That is, the flap 71 includes a surface which intersects a tangent line to the second pair of rollers 69 (the intermediate roller 30 and the second driven roller 32). In addition, it is preferable that the line DU on the flap 71 be parallel to the horizontal direction. That is, the flap 71 is installed such that the medium P is not hindered from being transported.

In addition, the flap 71 may be configured to bend the medium P in a direction which is perpendicular to the transportation direction of the medium P and is perpendicular to the vertical direction (that is, the width direction of the medium P). For example, a rib may be provided on the upper surface of the flap 71 so that the medium P is bent. With the medium P being bent, the medium P leaning downward and forward in the transportation direction is suppressed. Furthermore, it is preferable that the medium P be bent into a waveform shape.

Meanwhile, the flap 71 changes the transportation direction of the medium P. Therefore, in a case where the rigidity of the medium P is high, there is a concern that the medium P is folded when passing through an area between the second driven roller 32 and the flap 71. Therefore, as described above, the degree of inclination of the flap 71 may be changed according to the type of the medium P. For example, when the rigidity of the medium P is high (that is, when the stiffness is high), the flap 71 may be inclined downward in a direction toward the downstream side. The inclination control of the flap 71 as described above may be controlled by using a motor or may be controlled mechanically.

Figure 7:
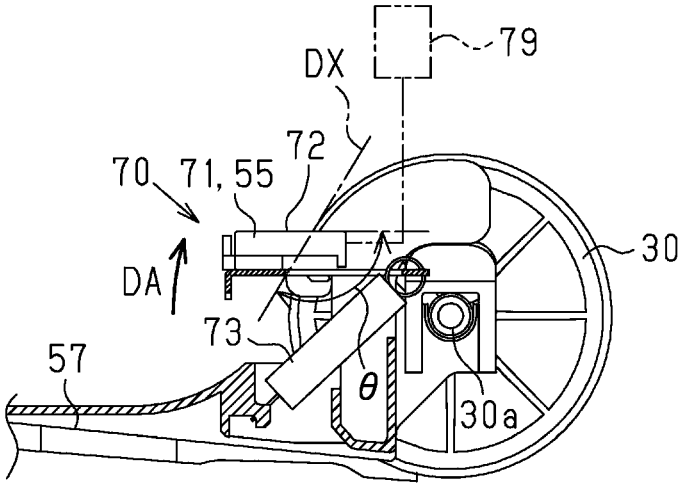
FIG. 7 is a partial sectional view taken along line VII-VII in FIG. 5 which illustrates a main portion of the printing device.

A mechanism shown in FIG. 7 is an example of a rotation type inclination control mechanism for the flap 71.

The flap 71 rotates around an axis which is parallel to an axial direction of the pair of transporting rollers 33. For example, the axis of rotation of the flap 71 is positioned at a lower portion of the flap 71. In addition, a spring 73 is attached to an end portion (an end portion opposite side to an end portion which the medium P passes) of the flap 71. The flap 71 is urged by the spring 73 such that the end portion (the end portion which the medium P passes) thereof moves upward. That is, the flap 71 is urged in a direction such that an intersection angle θ (refer to FIG. 7) between a plane (that is, a nip plane) including the tangent line DX between the second driven roller 32 and the intermediate roller 30 and the abutting surface 72 increases. In addition, the rotation of the flap 71 is restricted by a stopper. A position where the flap 71 abuts on the stopper is a standard position. The flap 71 can rotate from the standard position in a direction opposite to an urging direction DA. A force of the spring 73 is set such that the flap 71 rotates against the force of the spring 73 when the medium P with a high rigidity comes into contact with the flap 71. According to this configuration, when the leading end of the medium P with a high rigidity comes into contact with the flap 71, the degree of inclination of the flap 71 is changed. Note that, a device (hereinafter, referred to as "a flap rotation control device 79) for rotating the flap 71 may be provided in order to rotate the flap 71. The flap rotation control device 79 includes a motor for rotating the flap 71. With the flap rotation control device 79, it is possible to set the degree of inclination of the flap 71 according to the type of the medium P in advance before the medium P passes the flap 71.

A space structure between the pair of transporting rollers 33 and the second driven roller 32 will be described with reference to FIG. 4.

Between the pair of transporting rollers 33 and the second driven roller 32, a space (hereinafter, referred to as "an overlap space SP") for overlapping the trailing portion of the preceding medium P and the leading portion of the following medium P is provided.

The overlap space SP is configured as a space for natural falling of the trailing portion of the medium P. Specifically, the overlap space SP is configured such that the trailing end of the medium P can move to a position below the second driven roller 32 when the medium P is transported and the trailing end of the medium P passes the second driven roller 32. That is, the overlap space SP is provided with a vertical gap in the transportation route.

The overlap space SP is configured a space between the ceiling wall portion 56 and the supporting member 57. That is, the overlap space SP is configured as a space in which the ceiling wall portion 56 restricts the medium P from moving upward and the supporting member 57 restricts the medium P from moving downward.

The ceiling wall portion 56 is disposed at a position as follows. That is, the ceiling wall portion 56 is disposed above a line (hereinafter, referred to as "the vertical line") connecting the nip point between the pair of transporting rollers 33 and the nip point between the intermediate roller 30 and the second driven roller 32 and is disposed at a position in which the ceiling wall portion 56 can restrict the medium P from moving (or being bent) to a position significantly higher than the vertical line. According to this configuration, it is possible to suppress escape of force applied to the medium P during the skew correction by using the ceiling wall portion 56.

The supporting member 57 supports the medium P at a position below the rotation shaft 30*a* of the intermediate roller 30. In this case, the vertical gap within which the medium P can move in the vertical direction is secured. The gap is secured in order to reliably overlap the mediums P (see below). In addition, it is preferable that the supporting member 57 supports the medium P at a position above the nip point between the pair of transporting rollers 33. In this case, a component (a component in the transportation direction) of the gravity force acts on the medium P in addition to the transporting force generated by the pair of transporting rollers 33 and thus the medium P is transported smoothly.

Next, a driving mechanism for each of the rollers and the printing head 38 will be described.

Figure 6:
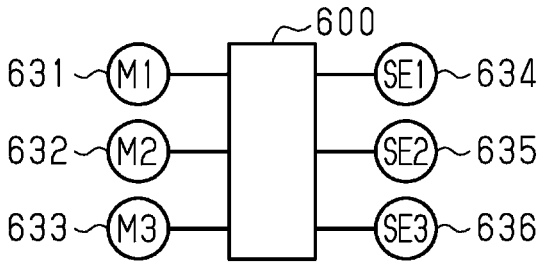
FIG. 6 is a control block diagram of the printing device.

The printing device 12 includes three motors (hereinafter, referred to as "a first motor 631", to "a third motor 633") as the driving mechanism (refer to FIG. 6).

The feeding roller 28 and the intermediate roller 30 are driven by the first motor 631. That is, the feeding roller 28 and the intermediate roller 30 are interlocked. A rotation ratio between the feeding roller 28 and the intermediate roller 30 is fixed to a predetermined value.

The transporting driving roller 33A of the pair of transporting rollers 33 and the discharging driving roller 34A of the pair of discharging rollers 34 are driven by the second motor 632. The printing head 38 is driven by a third motor 633. The first motor 631, the second motor 632, and the third motor 633 are controlled by a control device 600.

The control device 600 will be described with reference to FIG. 6.

The control device 600 controls driving of the first motor 631 to the third motor 633 on the basis of output signals from three sensors (hereinafter, referred to as "a first sensor 634" to "a third sensor 636") so as to control the transportation position of the medium P. For example, the control device 600 overlaps the preceding medium P and the following medium P via driving control of the first motor 631, the second motor 632, and the third motor 633.

The first sensor 634 to the third sensor 636 detect whether the medium P is present or not.

The first sensor 634 is disposed right before (the upstream side) the pair of transporting rollers 33 in the transportation route. The second sensor 635 is disposed between the pair of transporting rollers 33 and the second driven roller 32 and is disposed below the ceiling wall portion 56 in the transportation route. The third sensor 636 is disposed right before (the upstream side) the second driven roller 32 in the transportation route.

For example, each of the first sensor 634 to the third sensor 636 is configured as a switch with a lever that rotates when coming into contact with the medium P. The first sensor 634 to the third sensor 636 as described above are turned on when detecting the medium P and turned off when not detecting the medium P. The control device 600 determines that the leading end of the medium P has passed the vicinity of the sensors when the state of the first sensor 634 to the third sensor 636 is changed from an "OFF" state to an "ON" state. The control device 600 determines that the trailing end of the medium P has passed the vicinity of the sensors when the state of the first sensor 634 to the third sensor 636 is changed from the "ON" state to the "OFF" state.

For example, the first sensor 634 is configured as a switch including the above-described swing member 58 (the lever). That is, as described above, regarding the swing member 58, when the leading end of the medium P comes into contact with the flap portion 582 in a direction from the upstream side to the downstream side, the flap portion 582 rotates toward the downstream side in the transportation direction Y. The first sensor 634 is configured to be turned on when the swing member 58 rotates and is configured to output a predetermined signal to the control device 600 when the first sensor 634 is in the ON state.

An operation of the printing device 12 will be described with reference to FIGS. 8A to 9. Note that, here, an overlap-transportation operation (the overlap-consecutive feeding operation) of overlapping the preceding medium P and the following medium P will be described. In the following description, the preceding medium P will be referred to as "the preceding medium PA" and the medium P which follows the preceding medium P is referred to as "the following medium PB".

When the printing is started, the control device 600 drives the first motor 631 at a low speed (hereinafter, referred to as "a first speed") and rotates the feeding roller 28 and the intermediate roller 30. As a result, the preceding medium PA is picked up from the first cassette 21 (or the second cassette 22) and is transported by the intermediate roller 30. When the leading end of the preceding medium PA passes the first driven roller 31 and the second driven roller 32 and reaches the first sensor 634, the first sensor 634 detects the leading end of the preceding medium PA (that is, the "OFF" state is switched to the "ON" state). When the first sensor 634 detects the leading end of the preceding medium PA, the control device 600 stops the first motor 631 after the first motor 631 rotates a predetermined number of times from the timing of the detection.

Figure 8A:
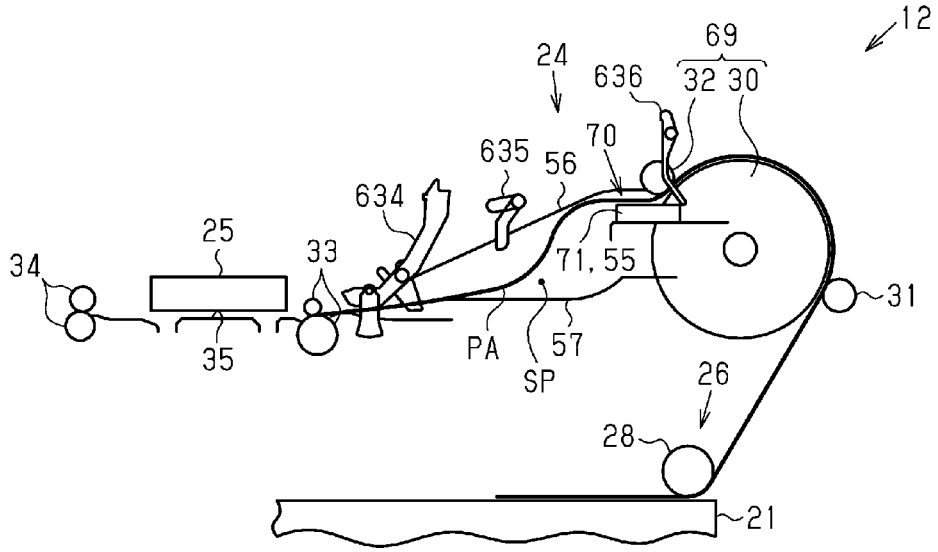
FIG. 8A is a schematic view illustrating an overlap-transportation operation of a medium.
Figure 9:
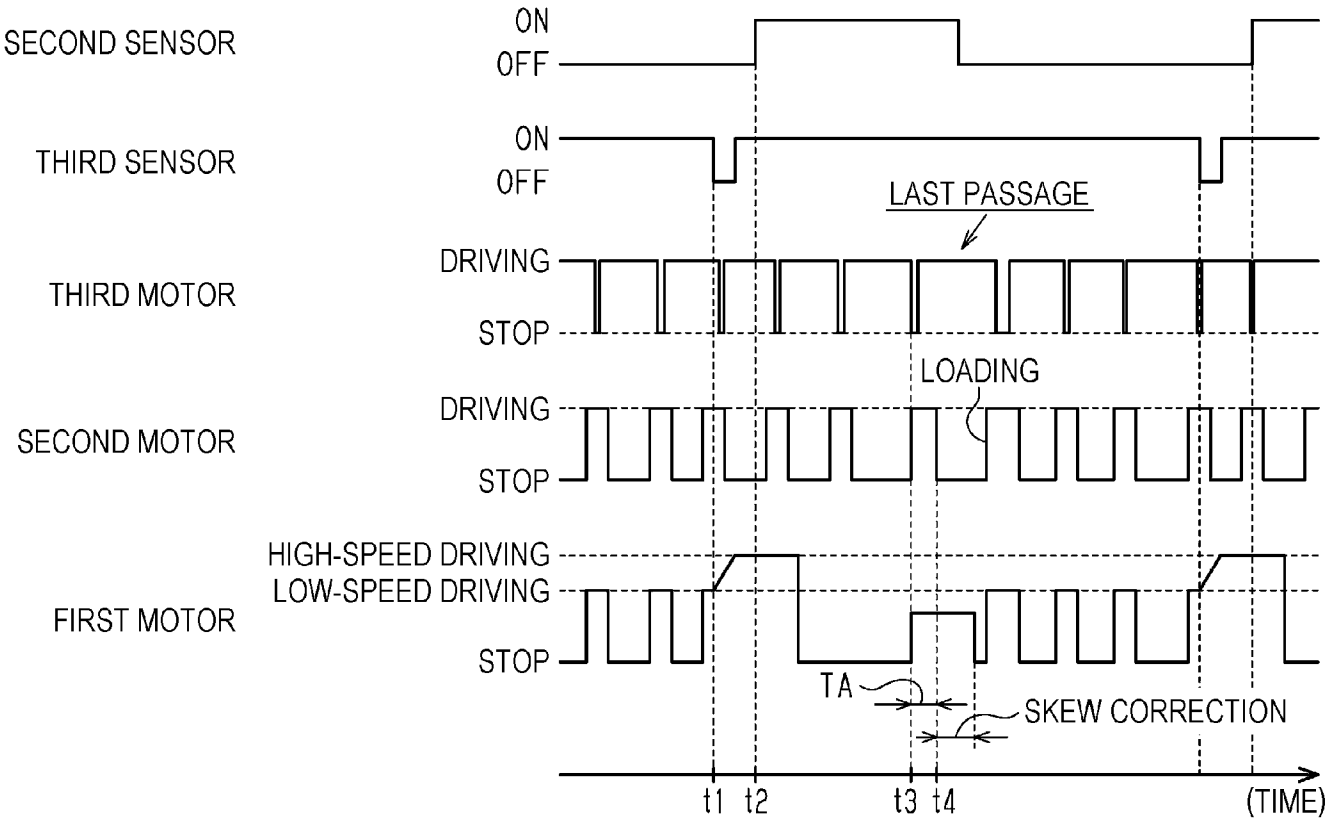
FIG. 9 is a timing chart of an operation of the printing device.

Next, as illustrated in FIG. 8A, the skew correction of the preceding medium PA is performed. Specifically, the control device 600 stops the second motor 632 and drives the first motor 631. That is, the preceding medium PA is pushed forward via the rotation of the intermediate roller 30 in a state where the preceding medium PA is pointed at the pair of transporting rollers 33.

Then, after a predetermined time has elapsed, loading of the preceding medium PA is performed. Specifically, the control device 600 drives the first motor 631 and the second motor 632 so that the preceding medium PA is transported until the leading end of the preceding medium PA reaches the printing start position. When the preceding medium PA reaches the printing start position, the control device 600 drives the third motor 633 and causes the printing unit 25 to start the printing.

Thereafter, according to the progress of the printing, the control device 600 intermittently drives the pair of transporting rollers 33, the pair of discharging rollers 34, and the intermediate roller 30 so that the preceding medium PA is intermittently transported. Note that, a series of operations in which the printing unit 25 reciprocates and performs the printing during a period in which the transportation is stopped is referred to as "one passage" and the last passage for one medium P is referred to as "the last passage".

As the printing on the preceding medium PA proceeds, the medium P moves forward intermittently. When the trailing end of the preceding medium PA passes the feeding roller 28, the following medium PB is picked up by the feeding roller 28. At this time, the rotation rate of the feeding roller 28 is controlled to be lower than the rotation rates of the pair of transporting rollers 33 and the pair of discharging rollers 34. Therefore, the trailing end of the preceding medium PA and the leading end of the following medium PB are separated from each other.

Figure 8B:
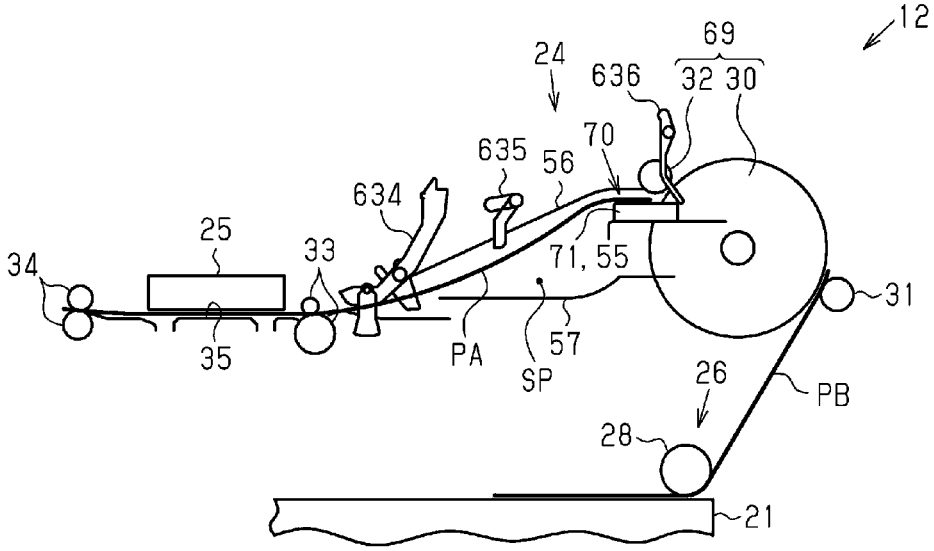
FIG. 8B is a schematic view illustrating the overlap-transportation operation of the medium.

When the trailing end of the preceding medium PA passes the third sensor 636 as illustrated in FIG. 8B and the third sensor 636 detects the trailing end of the preceding medium PA (that is, when the "ON" state is switched to the "OFF" state (refer to a time t1 in FIG. 9)), the rotation rate of the first motor 631 is increased. The first motor 631 is driven at a predetermined high speed (a speed higher than the first speed). When the high-speed driving of the first motor 631 is performed, the intermediate roller 30 rotates at a high rate, the following medium PB moves fast, and the following medium PB approaches the preceding medium PA.

After the trailing end of the preceding medium PA passes the third sensor 636, the trailing end of the preceding medium PA passes the second driven roller 32 and the flap 71. Then, the trailing portion of the preceding medium PA falls since the trailing end of the preceding medium PA is no longer supported. Meanwhile, the following medium PB is transported at a high speed so that the following medium PB approaches the preceding medium PA over a period around the falling of the trailing portion of the preceding medium PA. For this reason, when the leading end of the following medium PB passes the second driven roller 32 and the flap 71, the leading end of the following medium PB passes above the trailing portion of the preceding medium PA (refer to FIG. 8C) due to the momentum attributable to high speed transportation. In this manner, the trailing portion of the preceding medium PA and the leading portion of the following medium PB overlap.

Figure 8C:
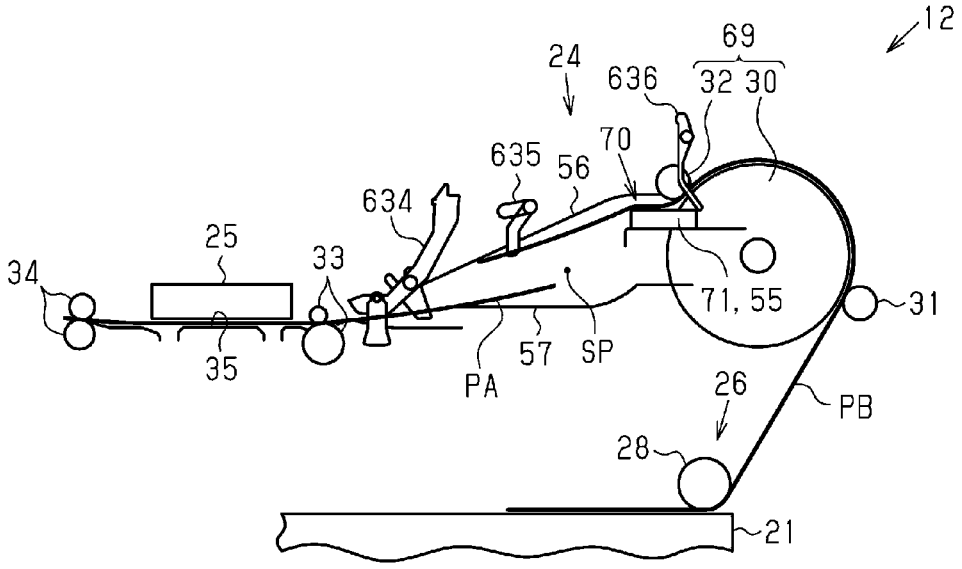
FIG. 8C is a schematic view illustrating the overlap-transportation operation of the medium.

As illustrated in FIG. 8C, when the leading end of the following medium PB passes above the trailing portion of the preceding medium PA, the leading end of the following medium PB passes through the vicinity of the second sensor 635. The control device 600 determines whether the preceding medium PA and the following medium PB have overlapped each other successfully on the basis of whether the second sensor 635 has detected the leading end of the following medium PB (refer to a time t2 in FIG. 9).

The control device 600 stops the high speed driving of the first motor 631 when a predetermined time has elapsed after the third sensor 636 detects the trailing end of the preceding medium PA.

Figure 8D:
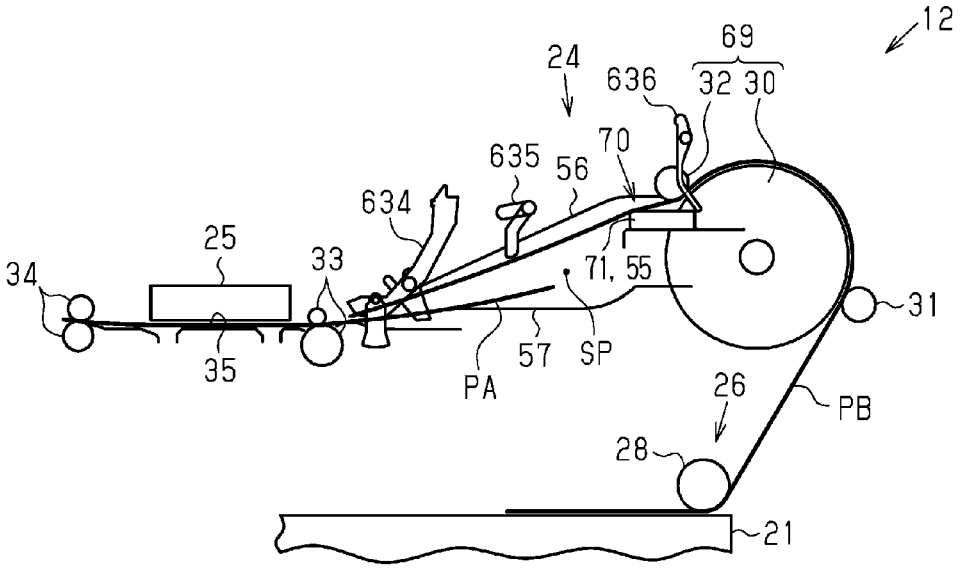
FIG. 8D is a schematic view illustrating the overlap-transportation operation of the medium.

Therefore, the following medium PB is not transported as illustrated in FIG. 8D until a passage immediately before the last passage for printing on the preceding medium PA is finished.

Figure 8E:
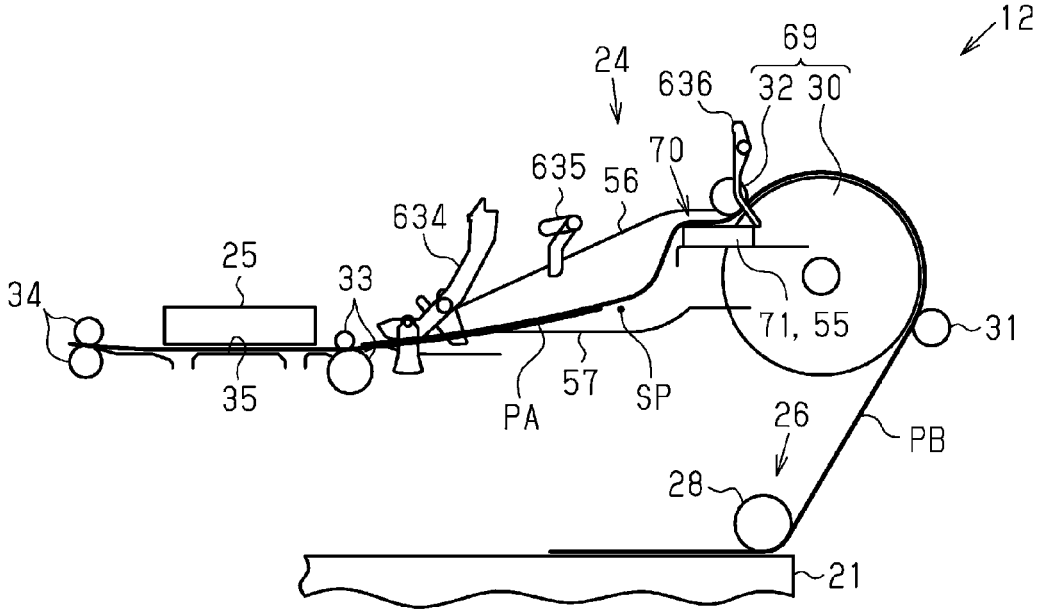
FIG. 8E is a schematic view illustrating the overlap-transportation operation of the medium.

When the passage immediately before the last passage for printing on the preceding medium PA is finished as illustrated in FIG. 8E (refer to a time t3 in FIG. 9), the control device 600 drives the first motor 631 and the second motor 632. Therefore, the preceding medium PA is transported by the pair of transporting rollers 33 and the following medium PB is transported by the pair of transporting rollers 33 and the intermediate roller 30. Then, when a predetermined time TA has elapsed after the first motor 631 and the second motor 632 start to rotate (that is, at a time t4), the control device 600 stops the second motor 632 only. That is, the control device 600 pushes forward the following medium PB by driving the intermediate roller 30 (for a predetermined time after the time t4 in FIG. 9) in a state where the leading end of the following medium PB is in contact with the pair of transporting rollers 33 which is in a stationary state. In this manner, the skew correction of the following medium PB is performed. After the skew correction is performed, loading of the following medium PB is performed. Note that, in terms of control, operations after the loading is repeated while regarding the following medium PB shown in FIG. 8E as the preceding medium PA.

Next, overlap determination which the control device 600 performs will be described.

There may be a case where the preceding medium PA and the following medium PB do not overlap each other during the above-described transporting process in which the preceding medium PA and the following medium PB overlap each other. For example, there may be a case where the leading portion of the following medium PB leans downward when the leading end of the following medium PB passes the flap 71. In this case, if the leading end of the following medium PB abuts onto the trailing end of the preceding medium PA as the following medium PB is transported forward, the following medium PB does not overlap the preceding medium PA. It is preferable that the above-described second sensor 635 be provided for the purpose of detecting that the preceding medium PA and the following medium PB have not overlapped each other as described above.

When the leading end of the following medium PB passes through a predetermined height position (a predetermined height position which is higher than the supporting member 57 by a predetermined distance) or an area above the predetermined height position as described in FIG. 8C, the leading end of the following medium PB is detected by the second sensor 635. Meanwhile, when the leading end of the following medium PB passes through an area below the predetermined height position, the leading end of the following medium PB is not detected by the second sensor 635. If the leading end of the following medium PB is detected by the second sensor 635 at a predetermined timing (that is, when the "OFF" state is switched to the "ON" state (refer to the time t2 in FIG. 9)), the control device 600 determines that the preceding medium PA and the following medium PB have overlapped each other. In addition, if the leading end of the following medium PB is not detected by the second sensor 635 at the predetermined timing (that is, when the "OFF" state is maintained), the control device 600 determines that the preceding medium PA and the following medium PB have not overlapped each other. Note that, the predetermined timing is a timing after a predetermined time has elapsed after the leading end of the following medium PB passes the third sensor 636.

An operation of the printing device 12 will be described.

As described above, the printing device 12 includes the transportation route with the vertical gap as means for overlapping the preceding medium PA and the following medium PB. Specifically, the overlap space SP is provided on the upstream side of the printing unit 25 in the transportation route. In the overlap space SP, the leading portion of the medium P is nipped, the trailing portion is not supported, and the trailing portion can move downward. That is, in the overlap space SP, there is a space within which the trailing portion of the medium P can move downward from a position at a predetermined height. Since such an overlap space SP is provided in the middle of the transportation route, when the trailing portion of the medium P stops being supported as the medium P moves forward, the trailing portion of the medium P moves downward. Since the trailing portion of the medium P moves downward, the following medium P can be disposed above the preceding medium P. In this manner, the preceding medium PA and the following medium PB overlap each other.

In short, the transportation direction changing mechanism 70 changes the transportation direction of the following medium PB such that the following medium PB overlaps the preceding medium PA in a state (including a state where the printing can be performed) where the preceding medium PA is nipped by the pair of transporting rollers 33 (the first pair of rollers) and the printing on the preceding medium PA is in progress.

According to the means for overlapping the mediums P, a strong stress is not likely to be applied to the medium P related to printing. That is, since the preceding medium PA is not forcibly bent when the preceding medium PA and the following medium PB overlap each other, an excessive stress (a stress which may cause positional deviation of the printing region of the medium (the same applies to the following)) is not applied to the preceding medium PA.

According to the printing device 12 of the first embodiment, the following effects can be obtained.

(1) The printing device 12 includes the transportation direction changing mechanism 70. The transportation direction changing mechanism 70 changes the transportation direction of the following medium PB such that the following medium PB overlaps the preceding medium PA when the printing on the medium P is in progress (or when the printing may be performed) in a state where the preceding medium PA is nipped by the pair of transporting rollers 33 (the first pair of rollers). According to this configuration, the preceding medium PA is not forcibly bent when the preceding medium PA and the following medium PB overlap each other in a state where the preceding medium PA is nipped by the pair of transporting rollers 33. Therefore, an excessive stress is not likely to be applied to the preceding medium PA. Accordingly, it is possible to suppress a decrease in printing quality with respect to the medium P in the printing device 12 in which the preceding medium PA and the following medium PB are transported while being overlapped.

(2) In the above-described printing device 12, the transportation direction changing mechanism 70 is configured as the flap 71 that is disposed on the downstream side of the second pair of rollers 69 and is disposed right after the second pair of rollers 69, the second pair of rollers 69 being disposed on the upstream side of the pair of transporting rollers 33 (the first pair of rollers). The flap 71 includes the abutting surface 72 that extends along a direction intersecting a tangential direction to the second pair of rollers 69. The abutting surface 72 of the flap 71 is disposed such that the abutting surface 72 comes into contact with the leading end of the medium P which is transported being nipped by the second pair of rollers 69 so that the transportation direction of the medium P is changed due to the contact. According to this configuration, it is possible to change the transportation direction of the medium P before the medium P is nipped by the pair of transporting rollers 33 (the first pair of rollers). Accordingly, it is possible to simplify the configuration of the transportation direction changing mechanism 70 since it is sufficient to provide such a flap 71 as means for changing the transportation direction of the medium P.

(3) In the above-described printing device 12, the flap 71 is supported to be rotatable around an axis which is parallel to an axial direction of the pair of transporting rollers 33 (refer to FIG. 7). According to this configuration, it is possible to change the transportation direction of the medium P by rotating the flap 71.

(4) For example, the flap 71 is urged in a rotation direction thereof such that the intersection angle θ between the tangent line to the second pair of rollers 69 and the abutting surface 72 increases (that is, a direction toward the standard position). According to this configuration, the degree of inclination of the flap 71 changes when the medium P comes into contact with the flap 71 and a pressing force of the medium P acts on the flap 71 so that the flap 71 rotates against the urging force. That is, the higher the rigidity of the medium P is, the higher the degree of inclination of the flap 71 is.

(5) In addition, the flap 71 may be configured such that the flap rotation control device 79 changes the intersection angle θ between the tangent line to the second pair of rollers 69 and the abutting surface 72 according to the type of medium P. According to this configuration, the angle of the abutting surface 72 of the flap 71 which relates to change in transportation direction of the medium P can be changed in advance by using the flap rotation control device 79.

(6) The flap 71 may be configured to bend the medium P into a waveform shape in a direction perpendicular to the transportation direction of the medium P. For example, the abutting surface 72 of the flap 71 is provided with a rib so that a section of the medium P which is perpendicular to the transportation direction has a waveform shape. According to this configuration, with the medium P being bent, the medium P leaning downward and forward in the transportation direction is suppressed. Therefore, a direction in which the transportation direction changing mechanism 70 guides the medium P being deviated from a set direction is suppressed. Accordingly, the possibility of preceding medium PA and the following medium PB not overlapping each other is lowered.

Second Embodiment

Figure 10:
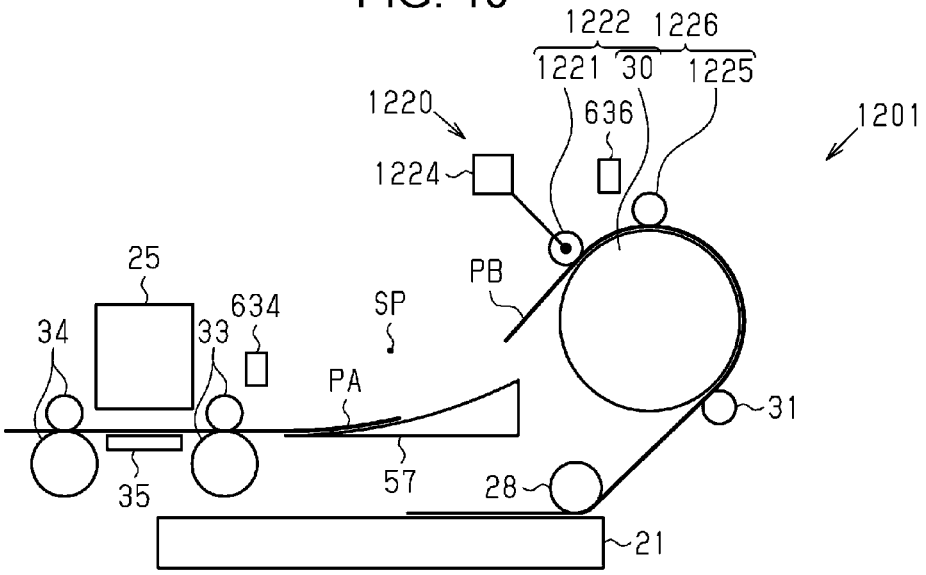
FIG. 10 is a schematic view of a printing device according to a second embodiment.

A printing device 1201 of a second embodiment will be described with reference to FIGS. 10 and 11.

As a transportation direction changing mechanism 1220, the printing device 1201 of the second embodiment includes the transportation direction changing mechanism 1220 instead of the flap 71 of the first embodiment. The transportation direction changing mechanism 1220 is different from the flap 71 in configuration. The transportation direction changing mechanism 1220 includes a movable roller 1221 which can establish and disestablish nip contact with the intermediate roller 30. Note that, the movable roller 1221 and the intermediate roller 30 constitute a "pair of nip contact controllable rollers 1222". The pair of nip contact controllable rollers 1222 is disposed on the upstream side of the pair of transporting rollers 33 (the first pair of rollers).

In addition, the printing device 1201 includes a fourth driven roller 1225 instead of the second driven roller 32 of the first embodiment. The fourth driven roller 1225 is disposed in the vicinity of the highest position in the outer periphery of the intermediate roller 30. Note that, the fourth driven roller 1225 and the intermediate roller 30 constitute a second pair of rollers 1226.

The movable roller 1221 is disposed on the downstream side of the fourth driven roller 1225. The movable roller 1221 moves between a first position which is a position close to the intermediate roller 30 as illustrated in FIG. 10 and a second position which is a position distant from the intermediate roller 30 as illustrated in FIG. 11. When the movable roller 1221 is disposed at the first position, nip contact between the movable roller 1221 and the intermediate roller 30 (that is, nip contact between the pair of nip contact controllable rollers 1222) is established, and when the movable roller 1221 is disposed at the second position, the nip contact between the movable roller 1221 and the intermediate roller 30 is disestablished. The movable roller 1221 is driven by a mechanism (hereinafter, referred to as a "nip contact control mechanism 1224") which moves the movable roller 1221 between the first position and the second position so that the nip contact is established or disestablished.

Transportation of the medium P when the preceding medium PA and the following medium PB do not overlap each other will be described with reference to FIG. 10. Regarding the transportation of the medium P, when the preceding medium PA and the following medium PB do not overlap each other, the movable roller 1221 is disposed at the first position by using the nip contact control mechanism 1224. At this time, the leading end of the medium P moves downward in a portion of the transportation route which is on the downstream side of the movable roller 1221.

Figure 11:
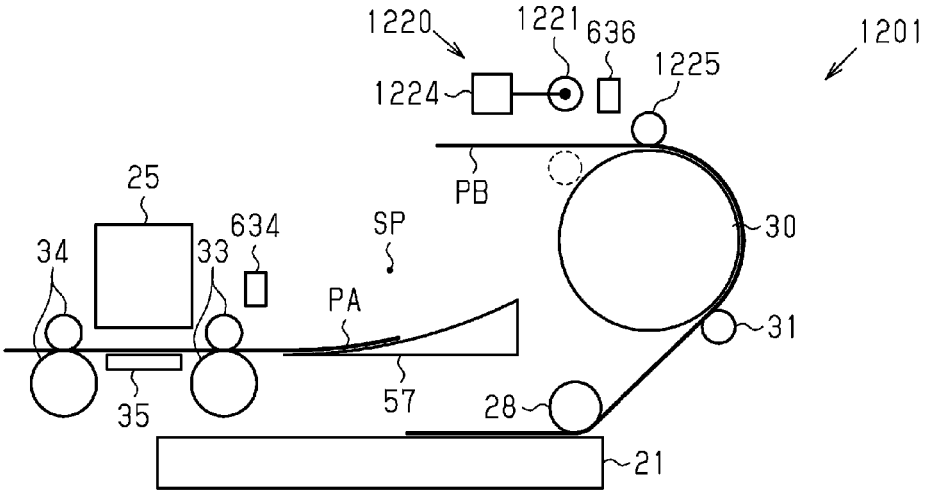
FIG. 11 is a schematic view illustrating an overlap-transportation operation of a medium in the printing device according to the second embodiment.

As illustrated in FIG. 11, in a case of overlaying the preceding medium PA with the following medium PB, the movable roller 1221 is disposed at the second position by using the nip contact control mechanism 1224. As a result, the medium P moves in the overlap space SP as follows. That is, when the leading end of the medium P passes the fourth driven roller 1225, the leading end moves upward (or substantially horizontally). When the medium P moves forward further, the leading end of the medium P gradually falls down and comes into contact with the pair of transporting rollers 33 so that the leading end is nipped by the pair of transporting rollers 33. Then, when the medium P moves forward further and the trailing end thereof passes through an area between the second pair of rollers 1226, the trailing end moves downward. When the following medium P is fed by the fourth driven roller 1225 thereafter, the leading end thereof moves upward as in the case of the preceding medium P, and thus the preceding medium PA and the following medium PB overlap each other.

In the second embodiment, the transportation direction changing mechanism 1220 includes the nip contact control mechanism 1224 which establishes and disestablishes the nip contact between the pair of nip contact controllable rollers 1222. According to this configuration, depending on whether the nip contact control mechanism 1224 establishes or disestablishes the nip contact between the pair of nip contact controllable rollers 1222, the pair of nip contact controllable rollers 1222 comes in contact with each other or not so that the transportation direction of the medium P, which is transported being nipped by the second pair of rollers 1226 on the upstream side of the pair of nip contact controllable rollers 1222, is changed.

In addition, as with the first embodiment, the preceding medium PA is not forcibly bent when the preceding medium PA and the following medium PB overlap each other in a state where the preceding medium PA is nipped by the pair of transporting rollers 33. Therefore, an excessive stress is not likely to be applied to the preceding medium PA. Accordingly, it is possible to suppress a decrease in printing quality with respect to the medium P.

Third Embodiment

A printing device 1301 of a third embodiment will be described with reference to FIGS. 12 and 13. As a transportation direction changing mechanism 1320, the printing device 1301 of the third embodiment includes a guide mechanism 1321 which changes the transportation direction of the medium P instead of the flap 71 of the first embodiment. The guide mechanism 1321 includes a pair of rollers 1322 and a change guide 1323 which guides the medium P. The change guide 1323 includes an upper guide member 1323*a* and a lower guide member 1323*b*. The upper guide member 1323*a* and the lower guide member 1323*b* are separated from each other such that one medium P can passes through therebetween. The upper guide member 1323*a* and the lower guide member 1323*b* are disposed to be parallel with each other. The upper guide member 1323*a* and the lower guide member 1323*b* rotate in conjunction with each other while maintaining a state where the upper guide member 1323*a* and the lower guide member 1323*b* are disposed to be parallel with each other in a state where a predetermined distance or more of separation distance therebetween is secured. One opening portion of the change guide 1323 is disposed in the vicinity of the nip point between the pair of rollers 1322 and the other opening portion of the change guide 1323 is directed toward the pair of transporting rollers 33.

An upper restriction member 1316 which defines an upper side of the overlap space SP restricts the following medium PB from moving upward.

A lower restriction member 1317 which defines a lower side of the overlap space SP includes a step portion 1318 on the downstream side and a space into which the following medium PB can be inserted is provided on the upstream side of the step portion 1318. The step portion 1318 supports the trailing portion of the preceding medium PA which is nipped by the pair of transporting rollers 33.

Figure 12:
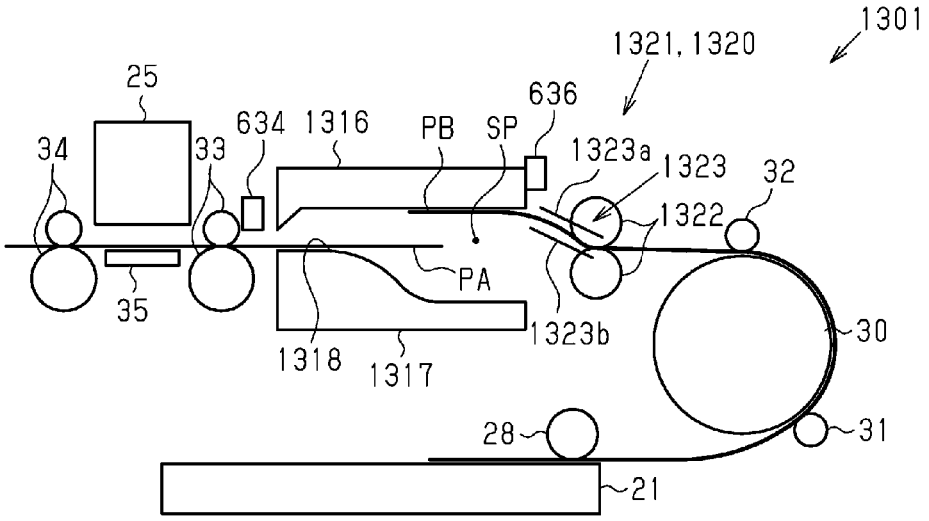
FIG. 12 is a schematic view illustrating an overlap-transportation operation of a medium in a printing device according to a third embodiment.

As illustrated in FIG. 12, in a case of overlaying the preceding medium PA with the following medium PB, the change guide 1323 is disposed such that the change guide 1323 is inclined upward in a direction toward the downstream side in the transportation route. As a result, the medium P moves in the overlap space SP as follows. That is, when the leading end of the medium P passes through an area between the pair of rollers 1322, the leading end moves upward along the change guide 1323. When the medium P moves forward further, the leading end of the medium P gradually falls down and comes into contact with the pair of transporting rollers 33 so that the leading end is nipped by the pair of transporting rollers 33. Then, when the medium P moves forward further and the trailing end thereof passes through an area between the pair of rollers 1322, the trailing end moves is supported by the step portion 1318 of the lower restriction member 1317. When the following medium PB is fed by the pair of rollers 1322 thereafter, the leading end thereof moves upward, and thus the preceding medium PA and the following medium PB overlap each other.

Figure 13:
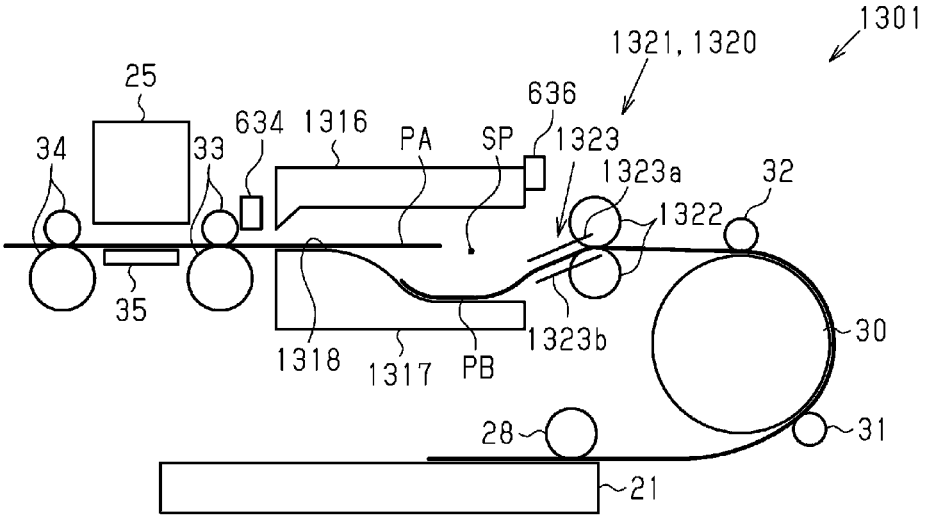
FIG. 13 is a schematic view illustrating another overlap-transportation operation of a medium in the printing device according to the third embodiment.

As illustrated in FIG. 13, in a case of underlaying the preceding medium PA with the following medium PB, the change guide 1323 is disposed such that the change guide 1323 is inclined downward in a direction toward the downstream side in the transportation route. Effects which can be obtained in this case are the same as in the case where the preceding medium PA is overlaid with the following medium PB.

In the third embodiment, the transportation direction of the medium P is changed when the guide direction of the change guide 1323 is switched. In addition, the change guide 1323 is capable of switching the transportation direction of the leading end portion of the medium P between an upward direction and a downward direction. Therefore, it is possible to switch between a transporting method in which the preceding medium PA is overlaid with the following medium PB and a transporting method in which the preceding medium PA is underlaid with the following medium PB.

In addition, as with the first embodiment, the preceding medium PA is not forcibly bent when the preceding medium PA and the following medium PB overlap each other in a state where the preceding medium PA is nipped by the pair of transporting rollers 33. Therefore, an excessive stress is not likely to be applied to the preceding medium PA. Accordingly, it is possible to suppress a decrease in printing quality with respect to the medium P.

Fourth Embodiment

A printing device 1401 of a fourth embodiment will be described with reference to FIGS. 14 and 15. As a transportation direction changing mechanism 1420, the printing device 1401 of the fourth embodiment includes a switchable flap 1421 which can switch the transportation direction, a guide member 1423, and a rotation mechanism 1424 which rotates the switchable flap 1421 and the guide member 1423, instead of the flap 71 of the first embodiment.

The switchable flap 1421 is disposed on the downstream side of the second driven roller 32. In addition, the switchable flap 1421 includes a medium separation claw 1422 on the leading end side thereof (opposite to the rotation axis side). When the medium separation claw 1422 comes into contact with the intermediate roller 30, the medium separation claw 1422 separates the medium P which moves along the intermediate roller 30 from the outer peripheral surface of the intermediate roller 30.

Figure 14:
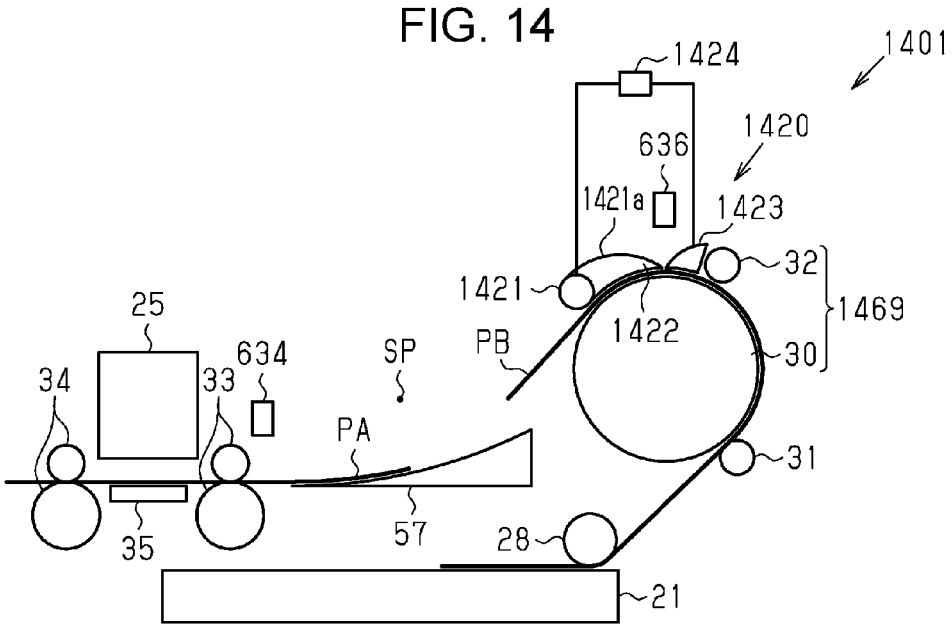
FIG. 14 is a schematic view of a printing device according to a fourth embodiment.
Figure 15:
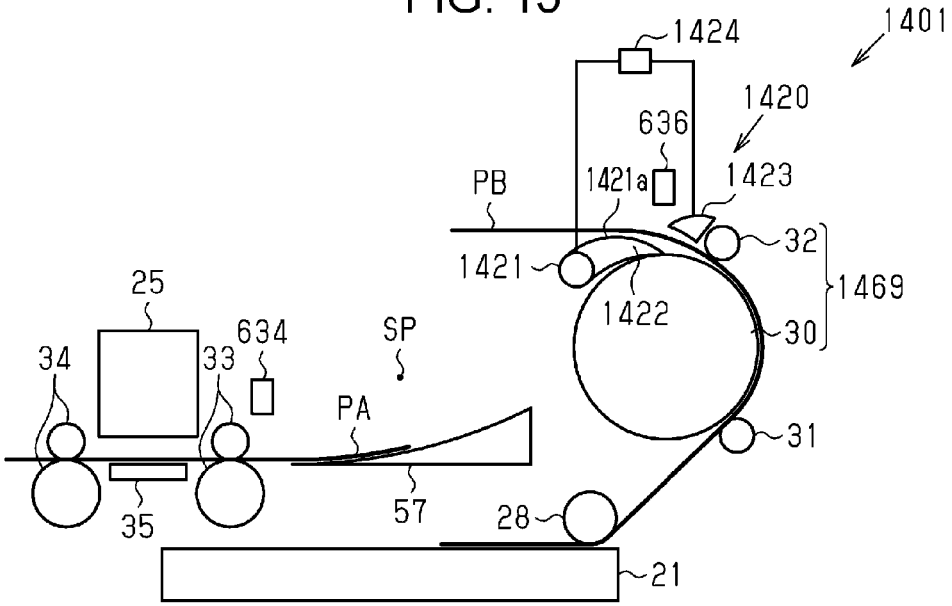
FIG. 15 is a schematic view illustrating an overlap-transportation operation of a medium in the printing device according to the fourth embodiment.

The switchable flap 1421 is rotatable, and the switchable flap 1421 rotates between a first position at which the medium separation claw 1422 is separated from the intermediate roller 30 as illustrated in FIG. 14 and a second position at which the medium separation claw 1422 comes in contact with the intermediate roller 30 as illustrated in FIG. 15. An outer surface 1421*a* (a surface which is opposite to a surface facing the intermediate roller 30) of the switchable flap 1421 is configured as a surface which intersects a nip plane between a second pair of rollers 1469. In addition, the outer surface 1421*a* of the switchable flap 1421 is configured to face upward in a direction toward the downstream side from a distal end of the medium separation claw 1422 when the switchable flap 1421 is disposed at the second position (refer to FIG. 15).

The guide member 1423 includes a surface of which the shape fits the shape of the outer peripheral surface of the intermediate roller 30. The guide member 1423 is interlocked with the switchable flap 1421. Specifically, when the switchable flap 1421 is disposed at the first position, the guide member 1423 is disposed at a first position. When the switchable flap 1421 is disposed at the second position, the guide member 1423 is disposed at a second position. The first position of the guide member 1423 is a position at which the guide member 1423 forms a route between the intermediate roller 30 and the guide member 1423 through which the medium P passes. The second position of the guide member 1423 is a position at which a distal end on the downstream side of the guide member 1423 is separated from the outer peripheral surface of the intermediate roller 30 and the guide member 1423 forms a route between the outer surface 1421*a* of the switchable flap 1421 and the guide member 1423 through which the medium P passes.

Transportation of the medium P when the preceding medium PA and the following medium PB do not overlap each other will be described with reference to FIG. 14. Regarding the transportation of the medium P, when the preceding medium PA and the following medium PB do not overlap each other, the switchable flap 1421 is disposed at the first position and the guide member 1423 is disposed at the first position. At this time, the medium P passes through an area between the switchable flap 1421 and the intermediate roller 30 and the medium P is transported such that the leading end of the medium P moves downward.

As illustrated in FIG. 15, in a case of overlaying the preceding medium PA with the following medium PB, the switchable flap 1421 is disposed at the second position and the guide member 1423 is disposed at the second position. As a result, the medium P moves in the overlap space SP as follows. That is, when the leading end of the medium P passes the second driven roller 32 and comes into contact with the medium separation claw 1422, the medium P moves along the outer surface 1421*a* of the switchable flap 1421. Accordingly, the leading end of the medium P moves upward. When the medium P moves forward further, the leading end of the medium P gradually falls down and comes into contact with the pair of transporting rollers 33 so that the leading end is nipped by the pair of transporting rollers 33. Then, when the medium P moves forward further and the trailing end thereof passes the switchable flap 1421, the trailing end moves downward. When the following medium PB is fed by the second driven roller 32 thereafter, the leading end thereof moves upward, and thus the preceding medium PA and the following medium PB overlap each other.

In addition, as with the first embodiment, the preceding medium PA is not forcibly bent when the preceding medium PA and the following medium PB overlap each other in a state where the preceding medium PA is nipped by the pair of transporting rollers 33. Therefore, an excessive stress is not likely to be applied to the preceding medium PA. Accordingly, it is possible to suppress a decrease in printing quality with respect to the medium P.

Fifth Embodiment

Figure 16:
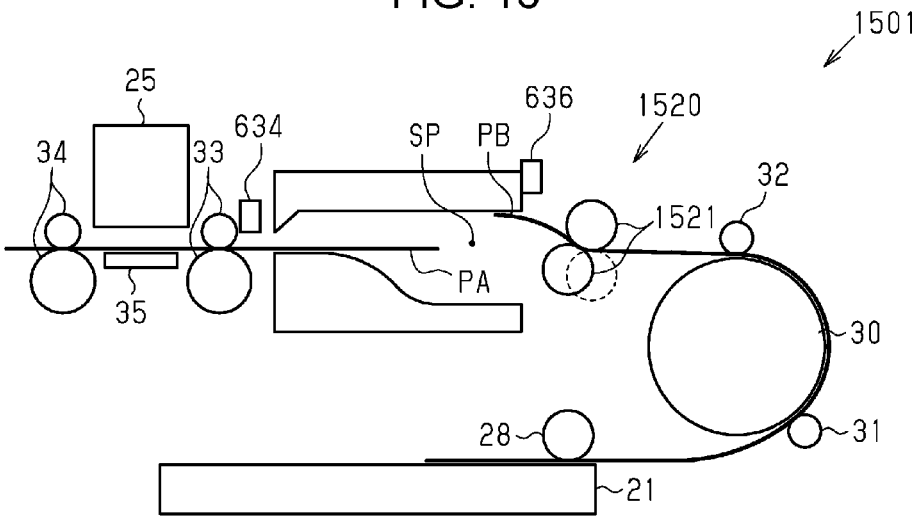
FIG. 16 is a schematic view of a printing device according to a fifth embodiment.

A printing device 1501 of a fifth embodiment will be described with reference to FIG. 16.

As a transportation direction changing mechanism 1520, the printing device 1501 of the fifth embodiment includes a pair of change rollers 1521 which changes the transportation direction of the medium P instead of the flap 71 of the first embodiment. The pair of change rollers 1521 is configured as a pair of rotatable rollers. The pair of change rollers 1521 is disposed on the downstream side of the second driven roller 32. The pair of change rollers 1521 can rotate as a whole and the pair of change rollers 1521 rotates between a first position at which a tangent line to the pair of change rollers 1521 extends in the horizontal direction and in a direction toward the downstream side in the transportation route as illustrated by a broken line in FIG. 16 and a second position at which the tangent line to the pair of change rollers 1521 extends upward in a direction toward the downstream side in the transportation route as illustrated by a solid line in FIG. 16.

Regarding the transportation of the medium P, when the preceding medium PA and the following medium PB do not overlap each other, the pair of change rollers 1521 is disposed at the first position. At this time, the pair of change rollers 1521 moves the medium P in the horizontal direction.

In a case of overlaying the preceding medium PA with the following medium PB, the pair of change rollers 1521 is disposed at the second position. As a result, the medium P moves in the overlap space SP as follows. When the leading end of the medium P passes through an area between the pair of change rollers 1521, the medium P moves along a tangential direction to the pair of change rollers 1521. That is, the leading end of the medium P moves upward. When the medium P moves forward further, the leading end of the medium P gradually falls down and comes into contact with the pair of transporting rollers 33 so that the leading end is nipped by the pair of transporting rollers 33. Then, when the medium P moves forward further and the trailing end thereof passes through the area between the pair of change rollers 1521, the trailing end moves downward. When the following medium PB is fed by the second driven roller 32 thereafter, the leading end thereof moves upward, and thus the preceding medium PA and the following medium PB overlap each other. Note that, in a case of underlaying the preceding medium PA with the following medium PB, the pair of change rollers 1521 may be disposed at a third position at which the tangent line to the pair of change rollers 1521 extends downward in a direction toward the downstream side in the transportation route.

In the fifth embodiment, when the pair of change rollers 1521 rotates as a whole, the tangential direction to the pair of change rollers 1521 is switched. That is, the transportation direction of the medium P is changed and thus the following medium PB overlaps the preceding medium PA. Accordingly, as with the first embodiment, the preceding medium PA is not forcibly bent when the preceding medium PA and the following medium PB overlap each other in a state where the preceding medium PA is nipped by the pair of transporting rollers 33. Therefore, an excessive stress is not likely to be applied to the preceding medium PA. Accordingly, it is possible to suppress a decrease in printing quality with respect to the medium P.

Note that, the pair of change rollers 1521 may be configured to be capable of switching a transportation direction of a leading end portion of the medium P between an upward direction and a downward direction (that is, switching between the second position and the third position). According to this configuration, it is possible to switch between a transporting method in which the preceding medium PA is overlaid with the following medium PB and a transporting method in which the preceding medium PA is underlaid with the following medium PB.

Sixth Embodiment

Figure 17:
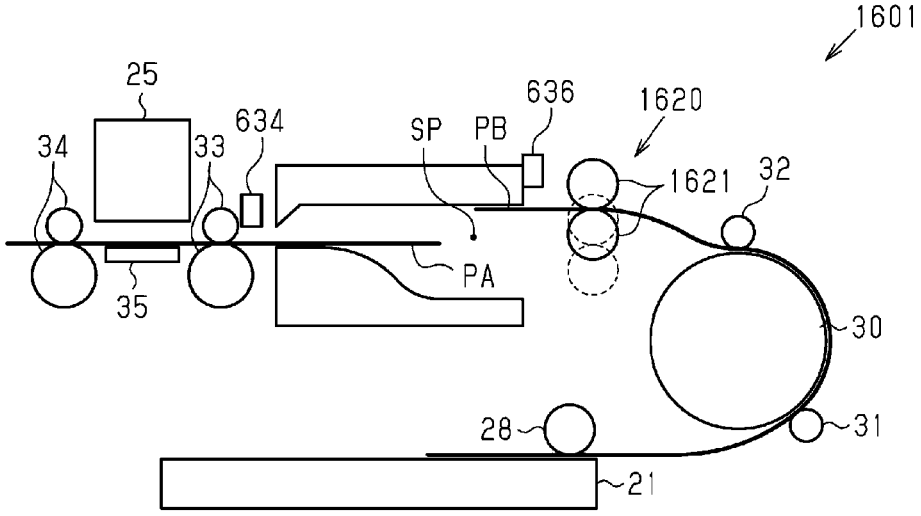
FIG. 17 is a schematic view of a printing device according to a sixth embodiment.

A printing device 1601 of a sixth embodiment will be described with reference to FIG. 17.

As a transportation direction changing mechanism 1620, the printing device 1601 of the sixth embodiment includes a pair of change rollers 1621 which changes the transportation direction of the medium P instead of the flap 71 of the first embodiment. The pair of change rollers 1621 is configured as a pair of movable rollers. The pair of change rollers 1621 is disposed on the downstream side of the second driven roller 32. The pair of change rollers 1621 can move in the vertical direction as a whole and the pair of change rollers 1621 moves between a first position and a second position. The first position is a position at which the height position of a nip point between the pair of change rollers 1621 becomes equal to the height position (hereinafter, referred to as "the standard height position") of the nip point between the pair of transporting rollers 33 as illustrated by a broken line in FIG. 17. The second position is a position at which the position of the nip point between the pair of change rollers 1621 becomes higher than the height position of the nip point between the pair of transporting rollers 33 as illustrated by a solid line in FIG. 17.

Regarding the transportation of the medium P, when the preceding medium PA and the following medium PB do not overlap each other, the pair of change rollers 1621 is disposed at the first position.

In a case of overlaying the preceding medium PA with the following medium PB, the pair of change rollers 1621 is disposed at the second position. As a result, the medium P moves in the overlap space SP as follows. When the leading end of the medium P passes through an area between the pair of change rollers 1621, the medium P moves along a tangential direction to the pair of change rollers 1621. That is, the leading end of the medium P moves above the standard height position. When the medium P moves forward further, the leading end of the medium P gradually falls down and comes into contact with the pair of transporting rollers 33 so that the leading end is nipped by the pair of transporting rollers 33. Then, when the medium P moves forward further and the trailing end thereof passes through the area between the pair of change rollers 1621, the trailing end moves downward. When the following medium PB is fed by the second driven roller 32 thereafter, the leading end moves above the standard height position, and thus the preceding medium PA and the following medium PB overlap each other.

In the sixth embodiment, when the pair of change rollers 1621 moves in the vertical direction as a whole, the position of the tangent line to the pair of change rollers 1621 (the position of the nip point) is switched in the vertical direction. That is, the transportation direction of the medium P is changed and thus the following medium PB overlaps the preceding medium PA.

Note that, the pair of change rollers 1621 may be configured to be capable of switching the height position of the nip point between the pair of change rollers 1621 between a position (a second position) higher than the standard height position and a position (a third position) lower than the standard position. According to this configuration, it is possible to switch between a transporting method in which the preceding medium PA is overlaid with the following medium PB and a transporting method in which the preceding medium PA is underlaid with the following medium PB.

In addition, as with the first embodiment, the preceding medium PA is not forcibly bent when the preceding medium PA and the following medium PB overlap each other in a state where the preceding medium PA is nipped by the pair of transporting rollers 33. Therefore, an excessive stress is not likely to be applied to the preceding medium PA. Accordingly, it is possible to suppress a decrease in printing quality with respect to the medium P.

Seventh Embodiment

Figure 18:
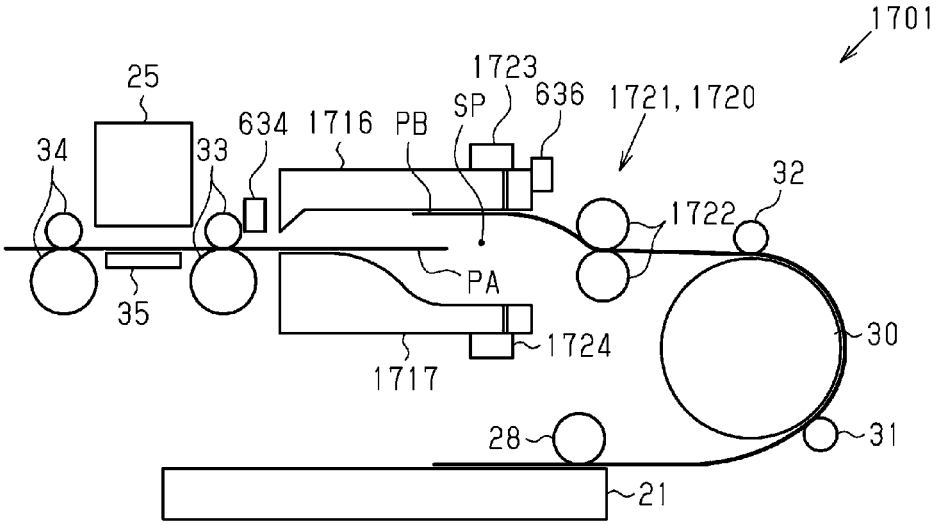
FIG. 18 is a schematic view of a printing device according to a seventh embodiment.

A printing device 1701 of a seventh embodiment will be described with reference to FIG. 18.

As a transportation direction changing mechanism 1720, the printing device 1701 of the seventh embodiment includes a suctioning control mechanism 1721 which changes the transportation direction of the medium P instead of the flap 71 of the first embodiment. The suctioning control mechanism 1721 suctions air in the overlap space SP for overlapping the trailing portion of the preceding medium PA and the leading portion of the following medium PB. For example, the suctioning control mechanism 1721 includes a pair of rollers 1722, a first suction device 1723 and a second suction device 1724. The pair of rollers 1722 is disposed on the downstream side of the second driven roller 32. The first suction device 1723 is disposed on the upstream side of an upper restriction member 1716. The second suction device 1724 is disposed on the upstream side of the lower restriction member 1717. The first suction device 1723 suctions air in the upper portion of the overlap space SP so that the medium P moves upward. The second suction device 1724 suctions air in the lower portion of the overlap space SP so that the medium P moves downward.

In a case of overlaying the preceding medium PA with the following medium PB, the first suction device 1723 is operated. As a result, the medium P moves in the overlap space SP as follows. Since the air pressure in the upper portion is lowered due to the first suction device 1723 being operated, when the leading end of the medium P passes through an area between the pair of rollers 1722, the leading end of the medium P moves upward. When the medium P moves forward further, the leading end of the medium P gradually falls down and comes into contact with the pair of transporting rollers 33 so that the leading end is nipped by the pair of transporting rollers 33. Then, when the medium P moves forward further and the trailing end thereof passes through the area between the pair of rollers 1722, the trailing end moves downward. When the following medium PB is fed by the second driven roller 32 thereafter, the leading end moves upward due to the suctioning operation performed by the first suction device 1723, and thus the preceding medium PA and the following medium PB overlap each other. Note that, in a case of underlaying the preceding medium PA with the following medium PB, the second suction device 1724 is operated. Effects which can be obtained in this case are the same as in the case where the preceding medium PA is overlaid with the following medium PB. In addition, it is possible to switch between a transporting method in which the preceding medium PA is overlaid with the following medium PB and a transporting method in which the preceding medium PA is underlaid with the following medium PB by selectively operating the first suction device 1723 and the second suction device 1724.

According to the printing device 1701 of the seventh embodiment, the transportation direction of the medium P is changed in a non-contact manner.

In addition, as with the first embodiment, the preceding medium PA is not forcibly bent when the preceding medium PA and the following medium PB overlap each other in a state where the preceding medium PA is nipped by the pair of transporting rollers 33. Therefore, an excessive stress is not likely to be applied to the preceding medium PA. Accordingly, it is possible to suppress a decrease in printing quality with respect to the medium P.

Note that, the seventh embodiment may be modified as follows. For example, an air sending control mechanism may be used instead of the suctioning control mechanism 1721. The air sending control mechanism ejects air to the overlap space SP for overlapping the trailing portion of the preceding medium PA and the leading portion of the following medium PB. For example, the air sending control mechanism ejects air to a lower surface or an upper surface of the medium P. In this manner, the transportation direction of the medium P is changed. According to this configuration, the same effects as in the second embodiment can be obtained.

Eighth Embodiment

Figure 19:
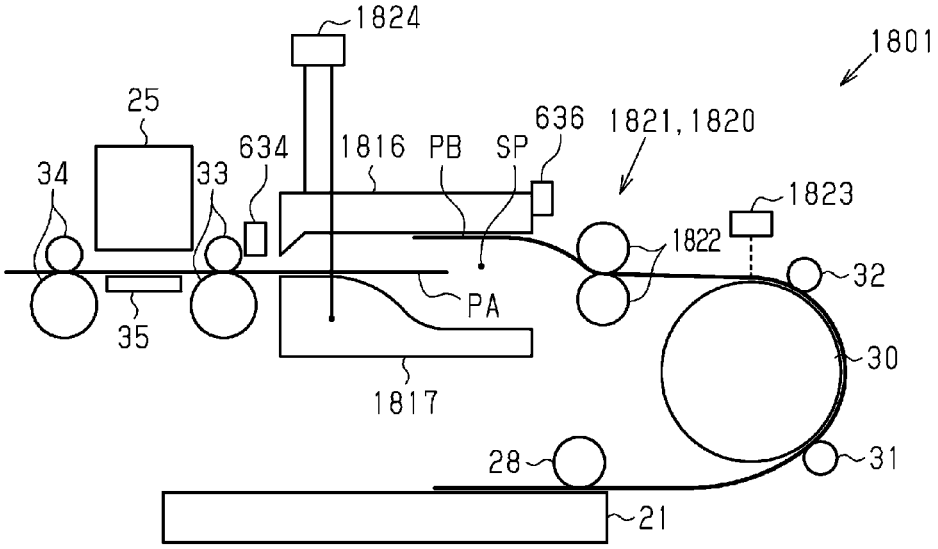
FIG. 19 is a schematic view of a printing device according to an eighth embodiment.

A printing device 1801 of an eighth embodiment will be described with reference to FIG. 19.

As a transportation direction changing mechanism 1820, the printing device 1801 of the eighth embodiment includes a static electricity control mechanism 1821 which changes the transportation direction of the medium P instead of the flap 71 of the first embodiment. The static electricity control mechanism 1821 electrically charges the medium P moving in the overlap space SP by performing electric charge control. For example, the static electricity control mechanism 1821 includes a pair of rollers 1822, a charging device 1823 and a potential control device 1824. The pair of rollers 1822 is disposed on the downstream side of the second driven roller 32. The charging device 1823 negatively charges the leading end of the medium P. The potential control device 1824 controls potentials of the upper restriction member 1816 and the lower restriction member 1817.

In a case of overlaying the preceding medium PA with the following medium PB, the charging device 1823 is operated such that the medium P is negatively charged and the potential of the upper restriction member 1816 becomes high. As a result, the medium P moves in the overlap space SP as follows. Since the leading end of the medium P is negatively charged, when the leading end of the medium P passes through an area between the pair of rollers 1822, the leading end of the medium P moves toward the upper restriction member 1816. When the medium P moves forward further, the leading end of the medium P is subjected to static elimination, gradually falls down, and comes into contact with the pair of transporting rollers 33 so that the leading end is nipped by the pair of transporting rollers 33. Then, when the medium P moves forward further and the trailing end thereof passes through the area between the pair of rollers 1822, the trailing end moves downward. When the following medium PB is fed by the second driven roller 32 thereafter, since the leading end of the following medium PB is in a state of being negatively charged as with the preceding medium PA, the leading end moves upward so that the preceding medium PA and the following medium PB overlap each other. In a case of underlaying the preceding medium PA with the following medium PB, the charging device 1823 is operated such that the leading end of the medium P is negatively charged (that is, the electric charge control is performed) and the potential of the lower restriction member 1817 becomes high. Effects which can be obtained in this case are the same as in the case where the preceding medium PA is overlaid with the following medium PB. In addition, it is possible to switch between a transporting method in which the preceding medium PA is overlaid with the following medium PB and a transporting method in which the preceding medium PA is underlaid with the following medium PB via potential switching control of the upper restriction member 1816 and the lower restriction member 1817. In this manner, in the printing device 1801 of the eighth embodiment, the transportation direction of the medium P is changed in a non-contact manner.

In addition, as with the first embodiment, the preceding medium PA is not forcibly bent when the preceding medium PA and the following medium PB overlap each other in a state where the preceding medium PA is nipped by the pair of transporting rollers 33. Therefore, an excessive stress is not likely to be applied to the preceding medium PA. Accordingly, it is possible to suppress a decrease in printing quality with respect to the medium P.

Ninth Embodiment

Figure 20:
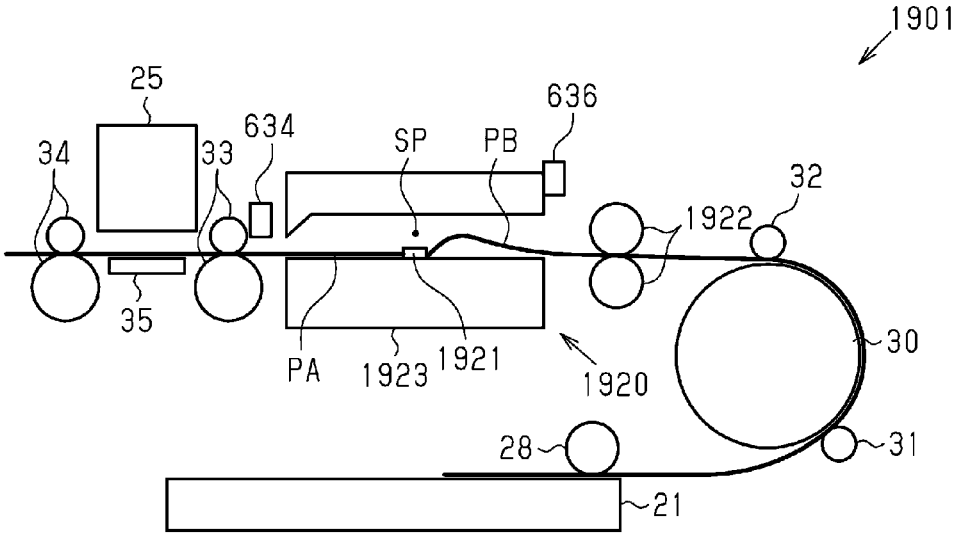
FIG. 20 is a schematic view illustrating an overlap-transportation operation of a medium in a printing device according to a ninth embodiment.
Figure 21:
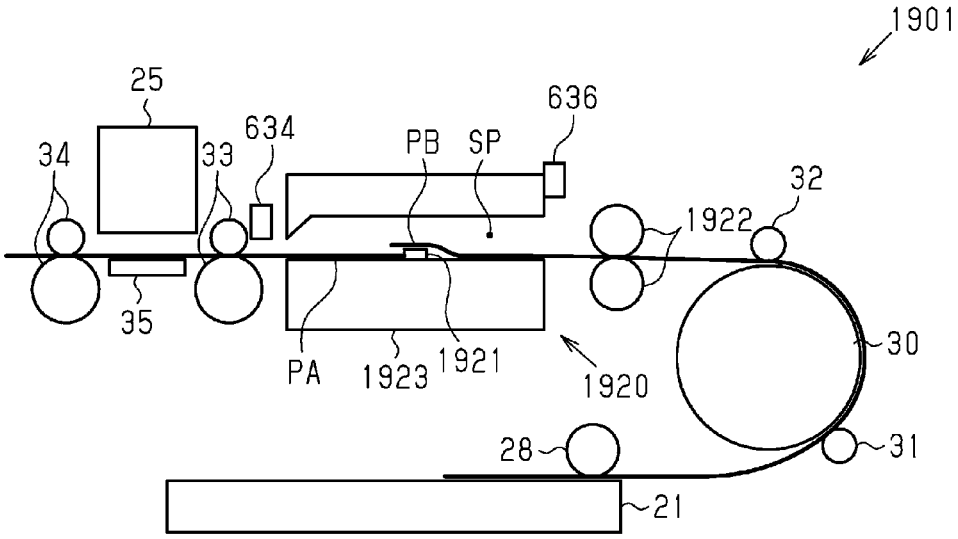
FIG. 21 is a schematic view illustrating the overlap-transportation operation of the medium in the printing device according to the ninth embodiment.

A printing device 1901 of a ninth embodiment will be described with reference to FIGS. 20 and 21.

As a transportation direction changing mechanism 1920, the printing device 1901 of the ninth embodiment includes a transportation direction changing structure 1921 and a pair of rollers 1922 instead of the flap 71 of the first embodiment. The pair of rollers 1922 is disposed on the downstream side of the second driven roller 32. The transportation direction changing structure 1921 is provided on a supporting portion 1923 which is disposed between the pair of rollers 1922 and the pair of transporting rollers 33. The transportation direction changing structure 1921 is configured as a protrusion which protrudes from a slide contact surface of the supporting portion 1923 with which the medium P comes into slide-contact. An end surface of the transportation direction changing structure 1921 on the upstream side is configured as a surface which extends in a direction perpendicular to the slide contact surface.

In a case of overlaying the preceding medium PA with the following medium PB, when the trailing end of the preceding medium PA passes the transportation direction changing structure 1921, the following medium PB is moved at a high speed so that the following medium PB passes the transportation direction changing structure 1921. According to this operation, the medium P moves in the overlap space SP as follows.

When the leading end of the medium P passes through an area between the pair of rollers 1922, the leading end of the medium P moves toward the transportation direction changing structure 1921 and the leading end of the medium P comes into contact with the transportation direction changing structure 1921. When the medium P moves forward further, the leading end of the medium P moves forward while passing the transportation direction changing structure 1921, and comes into contact with the pair of transporting rollers 33 so that the leading end is nipped by the pair of transporting rollers 33. Then, when the medium P moves forward further and the trailing end thereof passes the transportation direction changing structure 1921, a control device moves the following medium PB forward at a high speed. When the leading end of the following medium PB comes into contact with the transportation direction changing structure 1921, the leading end of the following medium PB moves upward. Since the following medium PB moves at a high speed, the leading end of the following medium PB falls down after passing the trailing end of the preceding medium PA. In this manner, the preceding medium PA and the following medium PB overlap each other.

Note that, in a case where the end surface of the transportation direction changing structure 1921 on the upstream side is perpendicular to the slide contact surface of the supporting portion 1923 as in the ninth embodiment, the following effects can be obtained. That is, when the medium P moves forward with the leading end of the medium P abutting on the transportation direction changing structure 1921, the leading portion of the medium P bends. Due to the bending, a movement distance (a distance by which the leading end moves forward from the transportation direction changing structure 1921) by which the leading end of the medium P moves when the leading end of the medium P passes the transportation direction changing structure 1921 after the bending is eliminated becomes larger than that in a case where the end surface of the transportation direction changing structure 1921 on the upstream side is an inclined surface. Accordingly, the possibility of preceding medium PA and the following medium PB not overlapping each other is lowered.

According to this configuration, as with the first embodiment, the preceding medium PA is not forcibly bent when the preceding medium PA and the following medium PB overlap each other in a state where the preceding medium PA is nipped by the pair of transporting rollers 33. Therefore, an excessive stress is not likely to be applied to the preceding medium PA. Accordingly, it is possible to suppress a decrease in printing quality with respect to the medium P.

OTHER EMBODIMENTS

Figure 22:
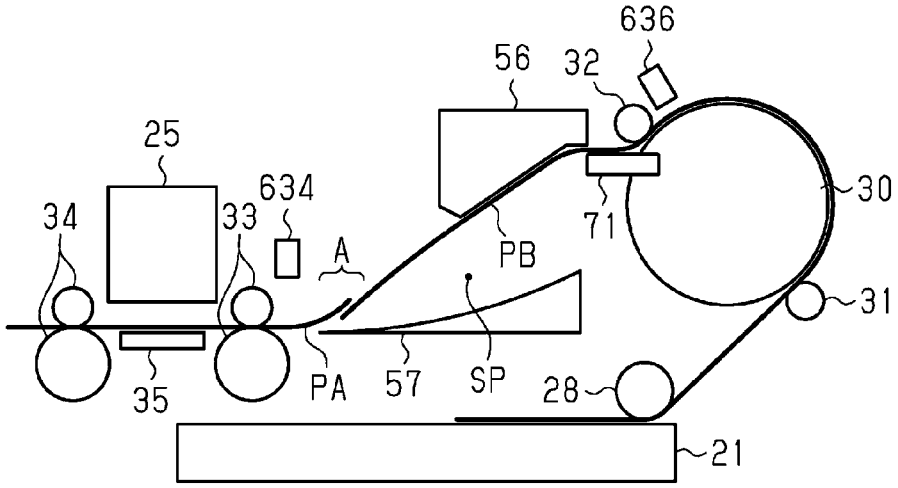
FIG. 22 is a schematic view illustrating a state where a following medium moves into a position below a preceding medium.
Figure 23:
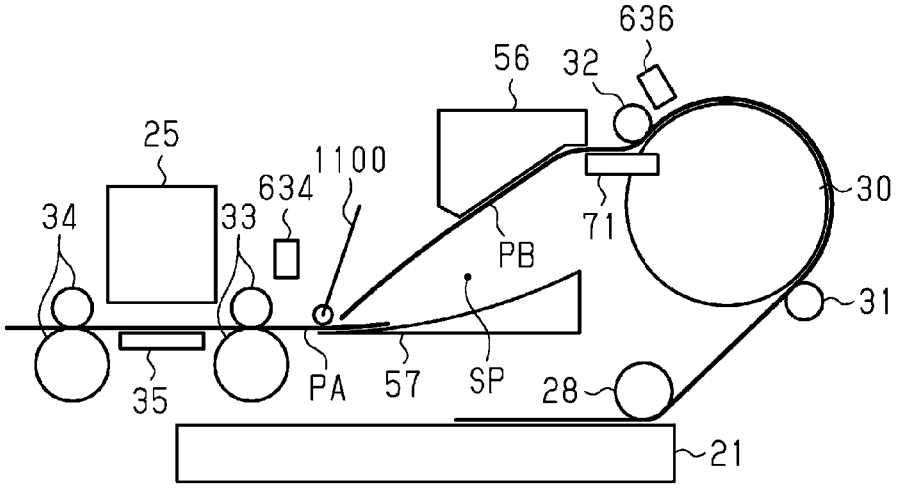
FIG. 23 is a schematic view of a printing device according to another embodiment.

The other embodiments will be described with reference to FIGS. 22 and 23.

When the medium P is stored in an environment with high humidity, the medium P may warp due to swelling. If the medium P warps, there is a concern that above-described overlapping of the preceding medium PA and the following medium PB may not be performed properly. For example, as illustrated in a section A in FIG. 22, when the trailing portion of the preceding medium PA warps upward, there is a concern that the leading end of the following medium PB may move into a position below the trailing portion of the preceding medium PA. In order to suppress such a situation, the trailing portion of the preceding medium PA may be pressed down by a roller 1100 as illustrated in FIG. 23 only for a predetermined period in which the following medium PB overlaps the preceding medium PA (for example, a period after the last passage (that is, a period in which the printing quality is not influenced)). According to this configuration, it is possible to suppress the leading end of the following medium PB moving into a position below the trailing portion of the preceding medium PA.

Figure 24:
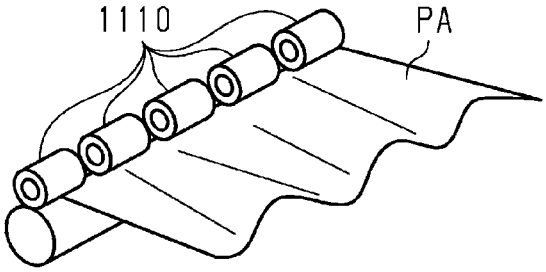
FIG. 24 is a schematic view illustrating a modification example of a pair of transporting rollers in the printing device according to the other embodiment.

Another example of eliminating the warping of the trailing portion of the preceding medium PA will be described with reference to FIG. 24. In this example, the medium P is deformed into a waveform shape in a direction perpendicular to the transportation direction by using a plurality of rollers 1110 which are arranged at predetermined intervals. According to this configuration, the rigidity (property of being not easily bent) of the medium P increases and upward warping of the trailing portion of the medium P is suppressed. Note that, it is preferable that the rollers 1110 be in contact with the medium P for a period after the last passage for printing on the medium P. This is to suppress a decrease in print quality attributable to the medium P being deformed by the plurality of rollers 1110.

Figure 25:
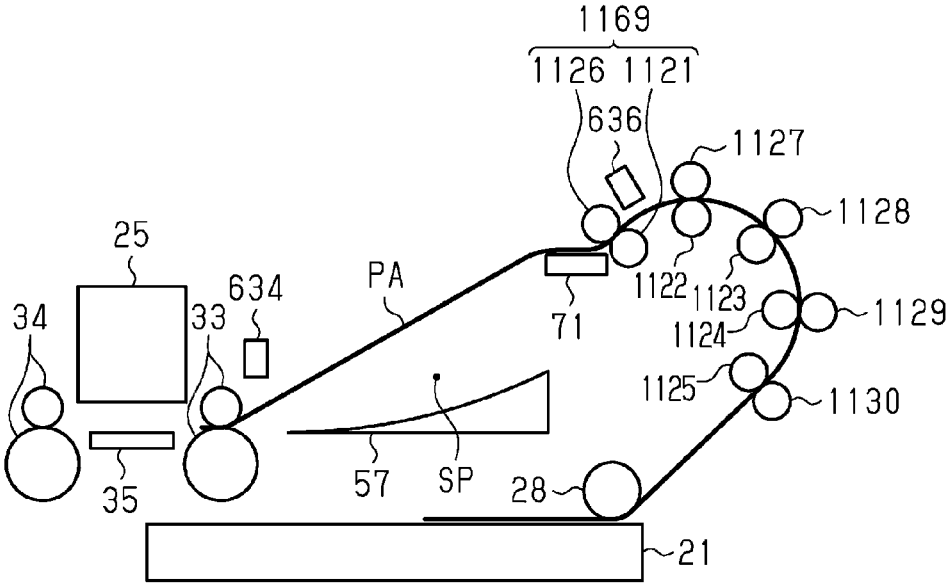
FIG. 25 is a schematic view of a printing device according to still another embodiment.

A modification example of the intermediate roller 30 of the embodiments will be described with reference to FIG. 25. In the first to ninth embodiments, the intermediate roller 30 is constituted by one roller. However, the intermediate roller 30 may be replaced with a plurality of rollers 1121 to 1125 as illustrated in FIG. 25. Each of the rollers 1121 to 1125 forms a pair with each of driven rollers 1126 to 1130. In this case, the roller 1121 on the lowermost stream side and the driven roller 1126 which forms a pair with the roller 1121 constitute a second pair of rollers 1169.

What is claimed is:

1. A printing device comprising:

a printing unit that performs printing on a transported medium;

a first pair of rollers that is disposed right before the printing unit and that rotates while nipping the medium to transport the medium to the printing unit;

a second pair of rollers that is disposed on an upstream side of the first pair of rollers and that transports the medium; and a transportation direction changing mechanism that is disposed on an upstream side of the first pair of rollers and that changes a transportation direction of the medium before the medium is nipped by the first pair of rollers, wherein, the transportation direction changing mechanism changes a transportation direction of a following medium such that a leading end portion of the following medium overlaps a preceding medium when the printing unit performs printing in a state where the preceding medium is nipped by the first pair of rollers, wherein the transportation direction changing mechanism is a flap that is disposed on a downstream side of the second pair of rollers and is disposed right after the second pair of rollers, and wherein the flap includes a surface that extends along a direction intersecting a tangential direction at a nip point between the second pair of rollers and the surface comes into contact with the medium which is transported being nipped by the second pair of rollers so that the transportation direction of the medium is changed.

2. The printing device according to claim 1, wherein the transportation direction changing mechanism is constituted of a change guide which can switch a guide direction or a pair of change rollers which can switch a tangential direction at a nip point therebetween, and wherein the change guide or the pair of change rollers comes into contact with the transported following medium and changes a transportation direction of a leading end portion of the following medium such that the leading end portion of the following medium overlaps the preceding medium.

3. The printing device according to claim 1, wherein the flap is supported to be rotatable around an axis which is parallel to an axial direction of the pair of rollers.

4. The printing device according to claim 3, wherein the flap is supported to be rotatable around the axis which is parallel to the axial direction of the first pair of rollers and is urged in a rotation direction thereof such that an intersection angle between the tangential direction to the second pair of rollers and the surface increases.

5. The printing device according to claim 3, wherein a flap rotation control device changes an intersection angle between the tangential direction and the surface of the flap according to the type of medium.

6. The printing device according to claim 1, wherein the transportation direction changing mechanism bends the medium into a waveform shape in a direction perpendicular to the transportation direction of the medium.

7. The printing device according to claim 1, wherein the transportation direction changing mechanism is capable of switching a transportation direction of a leading end portion of the medium between an upward direction and a downward direction.

8. A printing device comprising:

a printing unit that performs printing on a transported medium;

a first pair of rollers that is disposed right before the printing unit and that rotates while nipping the medium to transport the medium to the printing unit;

a second pair of rollers that is disposed on an upstream side of the first pair of rollers and that transports the medium; and a transportation direction changing mechanism that is disposed on an upstream side of the first pair of rollers and that changes a transportation direction of the medium before the medium is nipped by the first pair of rollers, wherein the transportation direction changing mechanism changes a transportation direction of a following medium such that a leading end portion of the following medium overlaps a preceding medium when the printing unit performs printing in a state where the preceding medium is nipped by the first pair of rollers, wherein the transportation direction changing mechanism includes a pair of nip contact controllable rollers which are disposed on a downstream side of the second pair of rollers and a nip contact control mechanism which establishes and disestablishes nip contact between the pair of nip contact controllable rollers.

9. A printing device comprising:

a printing unit that performs printing on a transported medium;

a pair of rollers that is disposed right before the printing unit and that rotates while nipping the medium to transport the medium to the printing unit; and a transportation direction changing mechanism that is disposed on an upstream side of the pair of rollers and that changes a transportation direction of the medium before the medium is nipped by the pair of rollers, wherein the transportation direction changing mechanism changes a transportation direction of a following medium such that a leading end portion of the following medium overlaps a preceding medium when the printing unit performs printing in a state where the preceding medium is nipped by the pair of rollers, wherein the transportation direction changing mechanism changes the transportation direction of the following medium such that a leading end portion of the following medium overlaps the preceding medium via 1) suctioning control of suctioning air in a space in which a trailing portion of the preceding medium and a leading portion of the following medium overlap each other, 2) air sending control of sending air to the space in an ejecting manner, or 3) electric charge control of electrically charging the medium moving in the space.

* * * * *